US011731012B2

(12) United States Patent
Mizutani et al.

(10) Patent No.: US 11,731,012 B2
(45) Date of Patent: Aug. 22, 2023

(54) GOLF CLUB HEAD

(71) Applicant: SUMITOMO RUBBER INDUSTRIES, LTD., Kobe (JP)

(72) Inventors: Naruhiro Mizutani, Kobe (JP); Tomohiro Hana, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 5 days.

(21) Appl. No.: 17/408,028

(22) Filed: Aug. 20, 2021

(65) Prior Publication Data

US 2022/0072391 A1 Mar. 10, 2022

(30) Foreign Application Priority Data

Sep. 10, 2020 (JP) ..... 2020-152349
Sep. 10, 2020 (JP) ..... 2020-152409

(51) Int. Cl.
*A63B 53/04* (2015.01)

(52) U.S. Cl.
CPC ..... *A63B 53/0466* (2013.01); *A63B 53/0433* (2020.08); *A63B 2209/00* (2013.01)

(58) Field of Classification Search
CPC ..... A63B 53/0433; A63B 53/0466
USPC ..... 473/324–350
See application file for complete search history.

(56) References Cited

U.S. PATENT DOCUMENTS 4,214,754 A * 7/1980 Zebelean ..... A63B 53/0466 473/346
4,432,549 A * 2/1984 Zebelean ..... A63B 53/0466 473/345
5,386,996 A * 2/1995 Hiruta ..... A63B 60/00 473/346
6,319,149 B1 * 11/2001 Lee ..... A63B 53/04 473/409
2011/0152003 A1 * 6/2011 Hartwell ..... A63B 53/0466 473/345

FOREIGN PATENT DOCUMENTS

JP 60-241466 A 11/1985
JP 06023070 A * 2/1994
JP 07255882 A * 10/1995 ..... A63B 53/04
JP 08047554 A * 2/1996 ..... A63B 53/04

* cited by examiner

*Primary Examiner* — Alvin A Hunter
(74) *Attorney, Agent, or Firm* — Birch, Stewart, Kolasch & Birch, LLP

(57) ABSTRACT

A hollow head includes a head body and a fixed member. The head body is formed by a first material. The fixed member is formed by a second material. The fixed member is disposed inside a body opening portion of the head body. The fixed member includes an outer peripheral portion and an inside region. At least a part of the outer peripheral portion is joined to an inner peripheral portion of the body opening portion. The inner peripheral portion includes a first engaging portion that is constituted by at least one projection or recess. The outer peripheral portion includes a second engaging portion that is constituted by at least one projection or recess. The first engaging portion and the second engaging portion form a projection-recess fitting. The inner surface of the inside region is located on a head outer side relative to an innermost end of a joining portion.

12 Claims, 24 Drawing Sheets

GOLF CLUB HEAD

CROSS REFERENCE TO RELATED APPLICATIONS

This application claims priorities to Japanese Patent Application No. 2020-152349 filed on Sep. 10, 2020 and Japanese Patent Application No. 2020-152409 filed on Sep. 10, 2020. The entire contents of these Japanese Patent Applications are hereby incorporated by reference.

BACKGROUND

Technical Field

The present disclosure relates to a golf club head.

Description of the Related Art

There has been known a golf club head including a head body made of a metal, and a metal member fixed to the head body and made of a metal different from that of the head body. JPS60-241466A discloses a head including: a head body made of a metal; and a metal member that is made of a metal different from that of the head body, has a melting point different from that of the head body, has a specific gravity higher than that of the head body, is disposed only in a hitting portion of the head body, and is fixed to the head body by insert casting.

SUMMARY

Using a head body and a member made of a material different from that of the head body and attached to the head body can enhance the degree of freedom in the design of the head such as the adjustability of the position of the center of gravity of the head. However, using different materials tends to reduce joining strength between the member and the head body.

One of the objects of the present disclosure is to provide a golf club head that has a high degree of design freedom and is excellent in joining strength between a head body and a fixed member.

According to one aspect, the present disclosure provides a golf club head including a hollow interior, a sole portion, and a hitting face portion. The head includes a head body and a fixed member that is fixed to the head body. The head body is formed by a first material having a first specific gravity. The fixed member is formed by a second material having a second specific gravity. The head body includes a body opening portion forming a body opening that penetrates through a wall of the head body from an outside of the head to the hollow interior. The fixed member forms a part of an inner surface and a part of an outer surface of the head and is disposed inside the body opening portion. The fixed member includes an outer peripheral portion and an inside region that is located inside the outer peripheral portion. At least a part of the outer peripheral portion is joined to an inner peripheral portion of the body opening portion such that the part of the outer peripheral portion and the inner peripheral portion form a joining portion. The inner peripheral portion of the body opening portion includes a first engaging portion that is constituted by at least one projection or recess. The outer peripheral portion of the fixed member includes a second engaging portion that is constituted by at least one projection or recess. The first engaging portion and the second engaging portion form a projection-recess fitting such that the inner peripheral portion and the outer peripheral portion are joined to each other. The inner surface of the inside region is located on a head outer side with respect to an innermost end of the joining portion.

According to another aspect, the present disclosure provides a golf club head including a hollow interior, a sole portion, and a hitting face portion. The head includes a head body and a fixed member that is fixed to the head body. The head body is formed by a first material having a first specific gravity. The fixed member is formed by a second material having a second specific gravity. The head body includes a body opening portion forming a body opening that penetrates through a wall of the head body from an outside of the head to the hollow interior. The fixed member forms a part of an inner surface and a part of an outer surface of the head and is disposed inside the body opening portion. At least a part of an outer peripheral portion of the fixed member is joined to an inner peripheral portion of the body opening portion such that the part of the outer peripheral portion and the inner peripheral portion form a joining portion. The inner peripheral portion of the body opening portion includes a first engaging portion that is constituted by at least one projection or recess, and a stepped portion that is formed on an outer-surface side of the head. The outer peripheral portion of the fixed member includes a second engaging portion that is constituted by at least one projection or recess, and an outer-surface forming projection that is constituted by at least one projection and forms a part of the outer surface of the head. The first engaging portion and the second engaging portion form a projection-recess fitting such that the inner peripheral portion and the outer peripheral portion are joined to each other. The outer-surface forming projection is engaged with the stepped portion.

DESCRIPTION OF THE PREFERRED EMBODIMENTS

Embodiments of the present disclosure will be described in detail below with reference to the drawings as necessary.

In the present disclosure, a reference state, a reference perpendicular plane, a toe-heel direction, a face-back direction, an up-down direction, a face center and a planar view are defined as follows.

Figure 24:
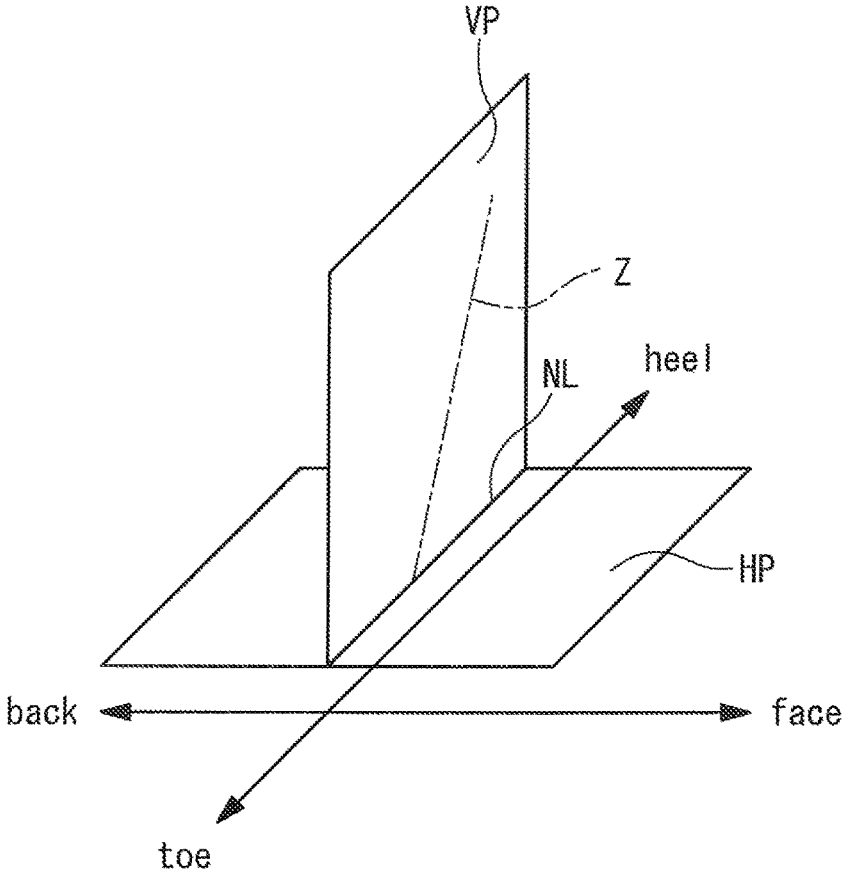
FIG. 24 is a conceptual diagram for illustrating a toe-heel direction and a face-back direction.

The reference state is a state where a head is placed at a predetermined lie angle and real loft angle on a horizontal plane HP. As shown in FIG. 24, in the reference state, a center line Z of a hosel hole is contained in a plane VP that is perpendicular to the horizontal plane HP. The plane VP is defined as the reference perpendicular plane. The predetermined lie angle and real loft angle are shown in a product catalog, for example.

In the present disclosure, the toe-heel direction is the direction of an intersection line NL between the reference perpendicular plane VP and the horizontal plane HP (see FIG. 24).

In the present disclosure, the face-back direction is a direction that is perpendicular to the toe-heel direction and is parallel to the horizontal plane HP.

In the present disclosure, the up-down direction is a direction that is perpendicular to the toe-heel direction and is perpendicular to the face-back direction. In other words, the up-down direction in the present disclosure is a direction perpendicular to the horizontal plane HP. The terms "upper side" and "upward" are determined based on this up-down direction. The terms "lower side" and "downward" are also determined based on this up-down direction.

In the present disclosure, the face center is determined as follows. First, a point Pr is selected at roughly the center of a face surface in the up-down direction and toe-heel direction. Next, a plane that passes through this point Pr, extends in the direction of a line normal to the face surface at the point Pr, and is parallel to the toe-heel direction is determined. An intersection line between this plane and the face surface is drawn, and a midpoint Px of the intersection line is determined. Next, a plane that passes through the midpoint Px, extends in the direction of a line normal to the face surface at the midpoint Px, and is parallel to the up-down direction is determined. An intersection line between this plane and the face surface is drawn, and a midpoint Py of the intersection line is determined. Next, a plane that passes through the midpoint Py, extends in the direction of a line normal to the face surface at the midpoint Py, and is parallel to the toe-heel direction is determined. An intersection line between this plane and the face surface is drawn, and a midpoint Px of the intersection line is newly determined. Next, a plane that passes through this new midpoint Px, extends in the direction of a line normal to the face surface at this midpoint Px, and is parallel to the up-down direction is determined. An intersection line between this plane and the face surface is drawn, and a midpoint Py of the intersection line is newly determined. Such points Px and Py are sequentially determined through repetition of this process. During the repeat of this process, when the distance between a new midpoint Py and the immediately previous midpoint Py becomes 0.5 mm or less for the first time, the new position Py (the final position Py) is set as the face center.

The planar view in the present disclosure means a projected figure (vertically projected figure) that is projected on a plane parallel to the horizontal plane HP.

First Embodiment

Figure 1:
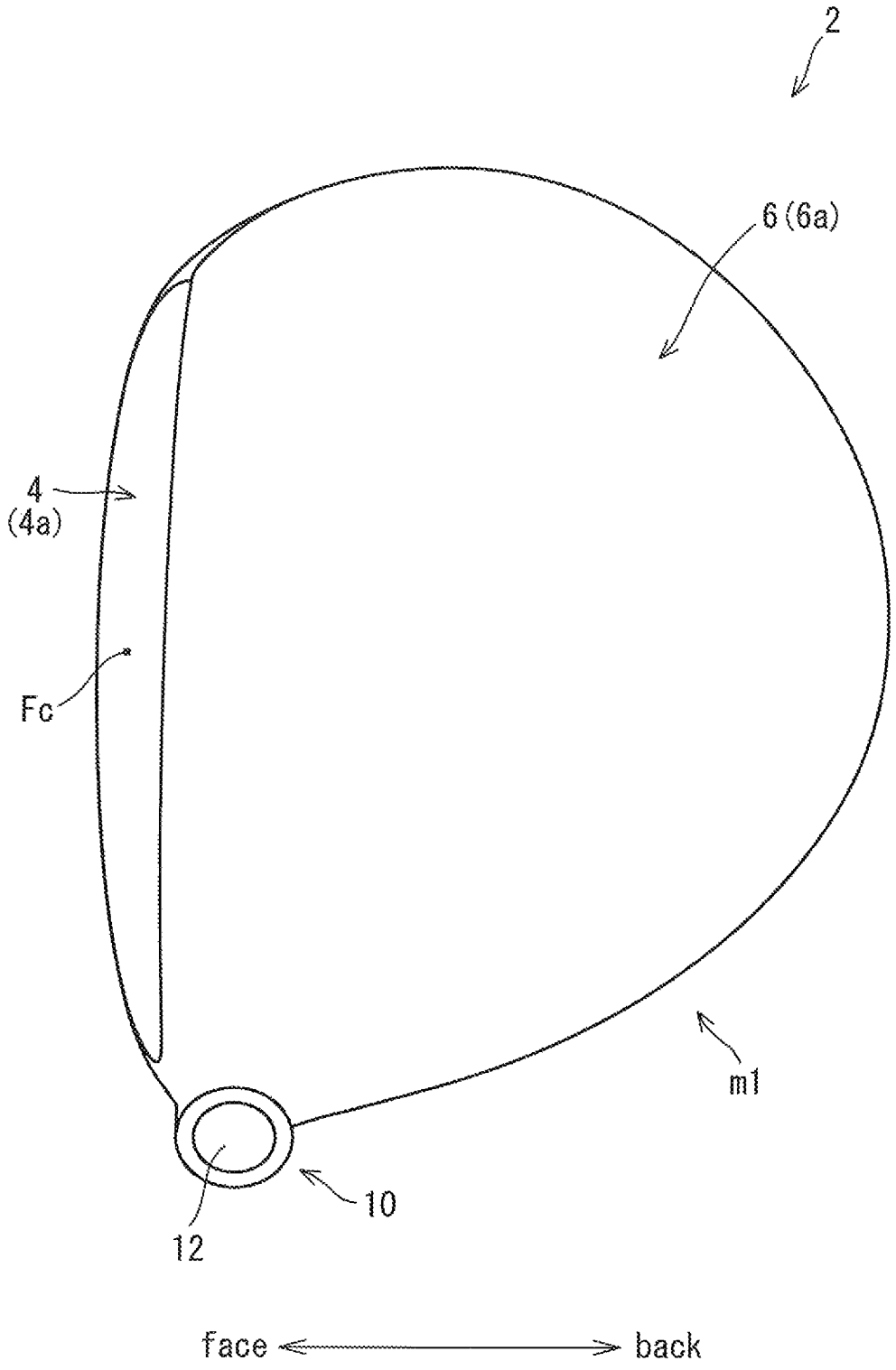
FIG. 1 is a plan view of a golf club head according to a first embodiment.
Figure 2:
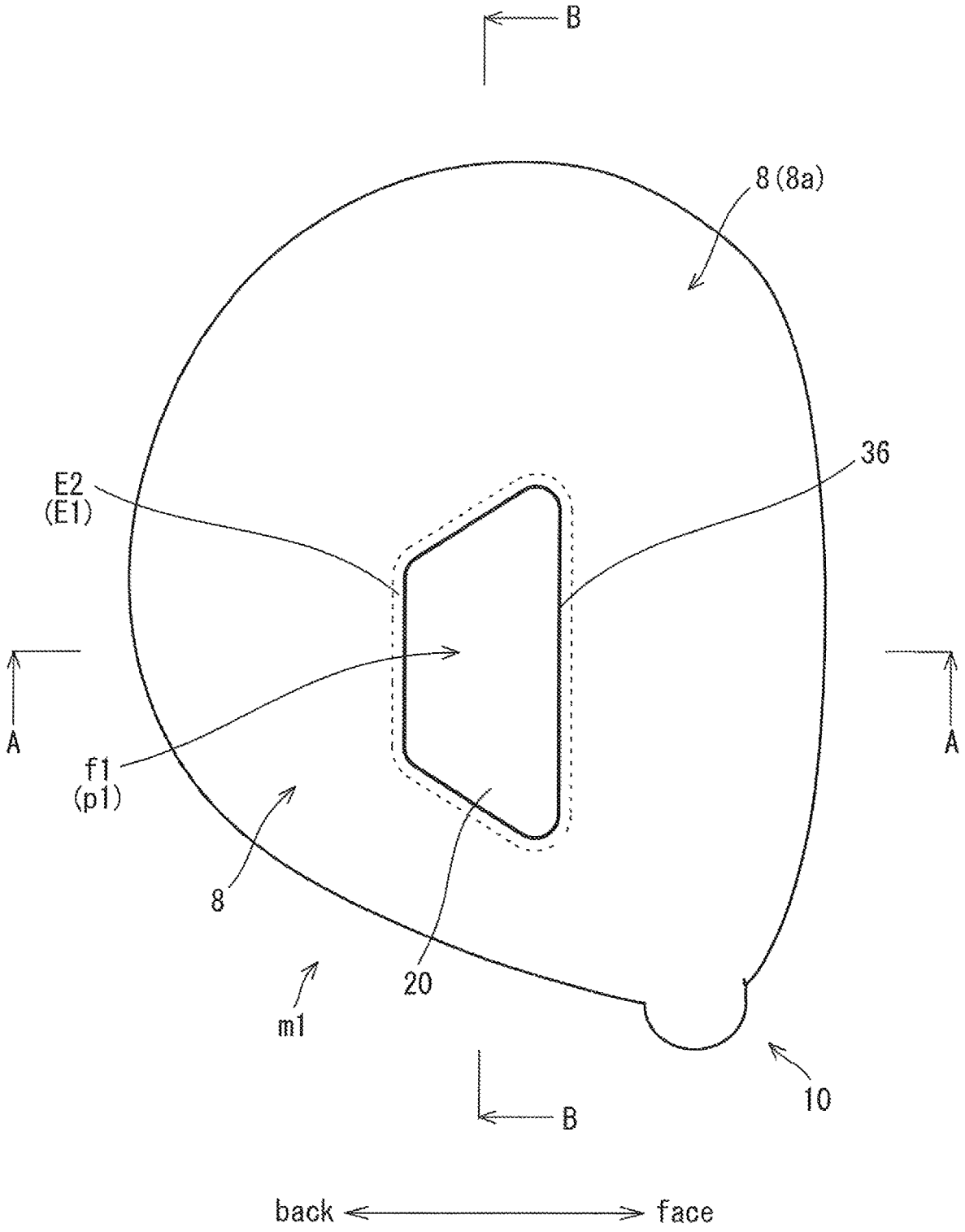
FIG. 2 is a bottom view of the head in FIG. 1.
Figure 3:
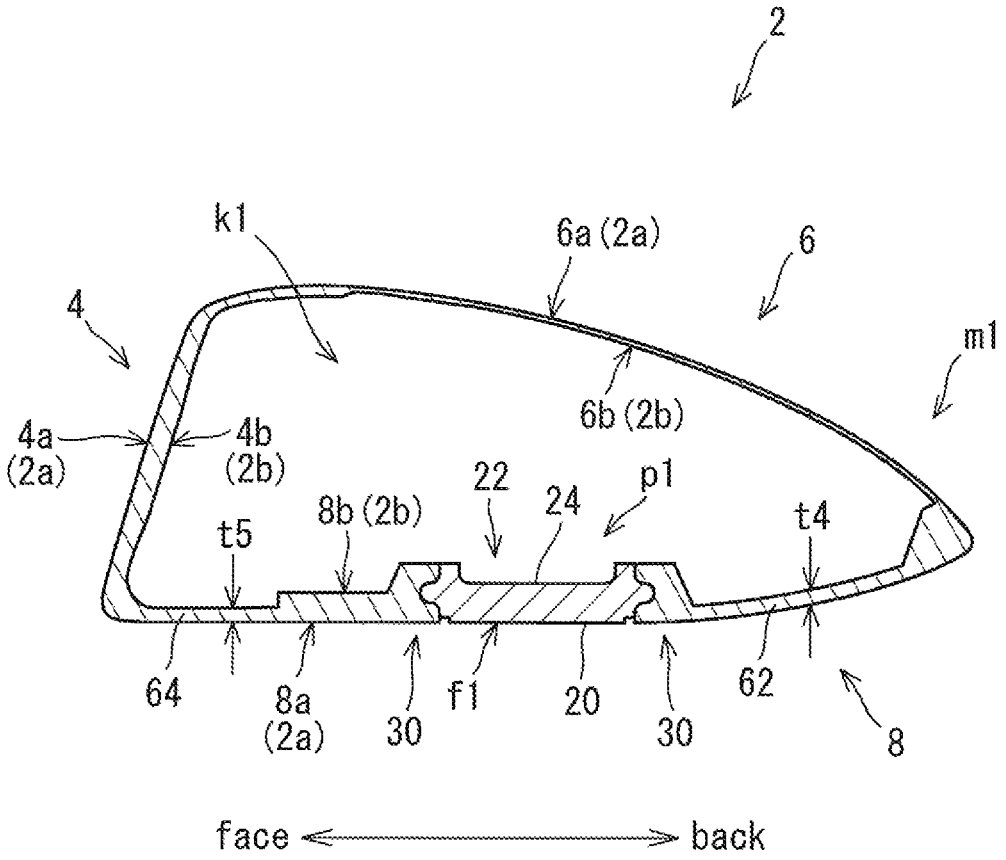
FIG. 3 is a cross-sectional view taken along line A-A in FIG. 2.
Figure 4:
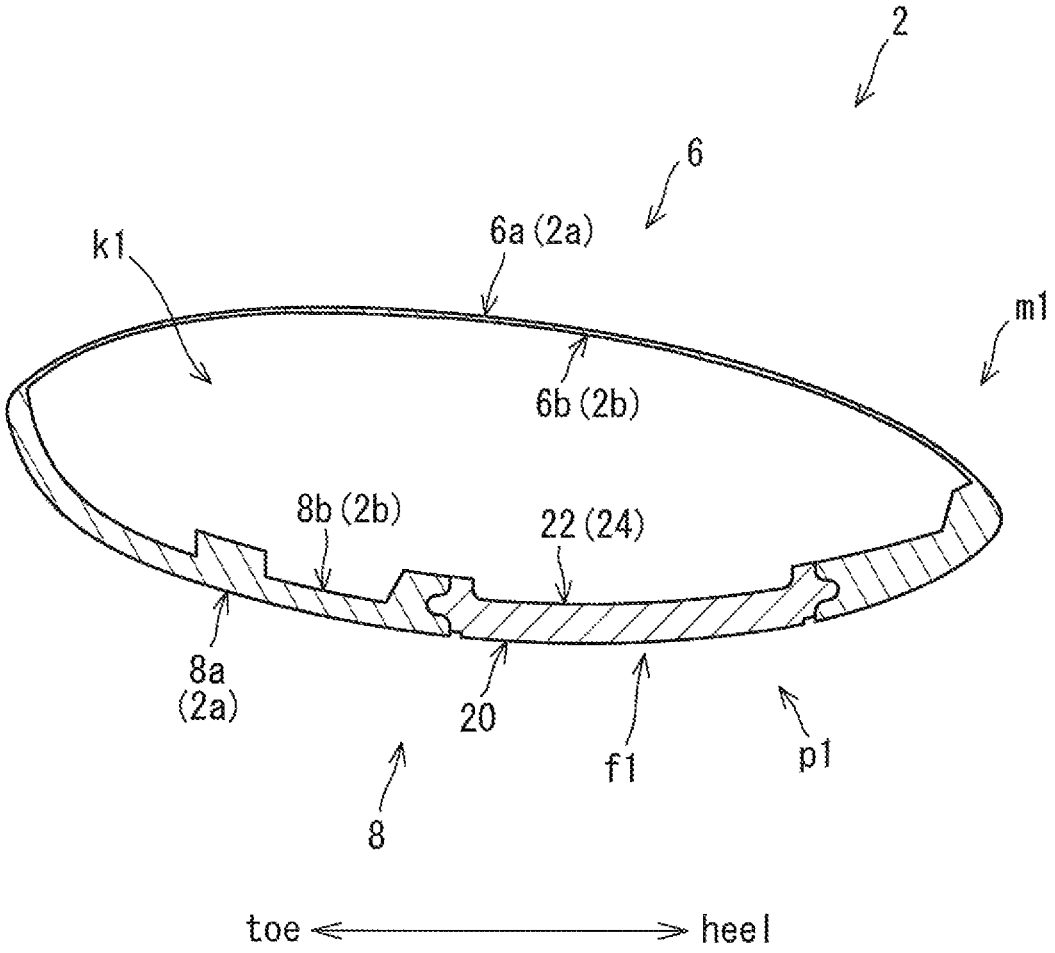
FIG. 4 is a cross-sectional view taken along line B-B in FIG. 2.

FIG. 1 is a plan view of a golf club head 2 according to a first embodiment. FIG. 2 is a bottom view of the head 2. FIG. 3 is a cross-sectional view taken along line A-A in FIG. 2. FIG. 4 is a cross-sectional view taken along line B-B in FIG. 2.

The head 2 includes a hitting face portion 4, a crown portion 6, a sole portion 8 and a hosel portion 10. The hosel portion 10 includes a hosel hole 12.

The head 2 is a wood type head. The head 2 is a fairway wood type head. Examples of the head 2 include a fairway wood type head, a hybrid type head, a driver head, and an iron type head.

As shown in FIG. 3 and FIG. 4, the head 2 includes a hollow interior k1. The head 2 is a hollow golf club head.

The hitting face portion 4 includes a face outer surface 4*a* and a face inner surface 4*b*. The face outer surface 4*a* forms a part of an outer surface 2*a* of the head 2. The face outer surface 4*a* is also referred to as a face surface. The face outer surface 4*a* has a face center Fc. The face inner surface 4*b* forms a part of an inner surface 2*b* of the head 2. The face inner surface 4*b* faces the hollow interior k1. The crown portion 6 includes a crown outer surface 6*a* and a crown inner surface 6*b*. The crown outer surface 6*a* forms a part of the outer surface 2*a* of the head 2. The crown inner surface 6*b* forms a part of the inner surface 2*b* of the head 2. The crown inner surface 6*b* faces the hollow interior k1. The sole portion 8 includes a sole outer surface 8*a* and a sole inner surface 8*b*. The sole outer surface 8*a* forms a part of the outer surface 2*a* of the head 2. The sole inner surface 8*b* forms a part of the inner surface 2*b* of the head 2. The sole inner surface 8*b* faces the hollow interior k1.

The head 2 includes a head body m1 and a fixed member f1. The head body m1 forms the entirety of the hitting face portion 4. The head body m1 forms the entirety of the crown portion 6. The head body m1 forms a part of the sole portion 8. The sole portion 8 is constituted by the head body m1 and the fixed member f1. The head body m1 forms the entirety of the hosel portion 10.

The head body m1 has an opening portion p1. The opening portion p1 is also referred to as a body opening portion. The body opening portion p1 is provided in the sole portion 8. The body opening portion p1 forms a through hole (body opening) that penetrates through a wall of the head body m1. The body opening portion p1 forms the through hole that penetrates through the wall of the head body m1 from the outer surface 2*a* of the head 2 to the inner surface 2*b* of the head 2. The body opening portion p1 forms the through hole that penetrates through the wall of the head body m1 from the outside of the head 2 to the hollow interior k1. The body opening portion p1 forms the through hole that penetrates through the sole portion 8. The body opening portion p1 forms the through hole that penetrates through the sole portion 8 from the sole outer surface 8*a* to the sole inner surface 8*b*.

The fixed member f1 is fixed to the head body m1. The fixed member f1 is not welded to the head body m1. The fixed member f1 is not glued to the head body m1. The method for fixing the fixed member f1 is described below. The fixed member f1 is located inside the body opening portion p1. The fixed member f1 is fixed to the inside of the body opening portion p1. The fixed member f1 blocks the through hole of the body opening portion p1. The fixed member f1 is formed separately from the head body m1. The center of gravity of the fixed member f1 is located at a heel-side position with respect to the face center Fc.

The fixed member f1 has an outer surface 20 that forms a part of the outer surface 2*a* of the head 2. The outer surface 20 of the fixed member f1 forms a part of the sole outer surface 8*a*. The fixed member f1 has an inner surface 22 that forms a part of the inner surface 2*b* of the head 2. The inner surface 22 of the fixed member f1 forms a part of the sole inner surface 8*b*. The inner surface 22 of the fixed member f1 faces the hollow interior k1. In the present embodiment in which the fixed member f1 is disposed in the sole portion 8, the inner surface 22 of the fixed member f1 is the upper surface of the fixed member f1, and the outer surface 20 of the fixed member f1 is the lower surface of the fixed member f1.

Figure 5:
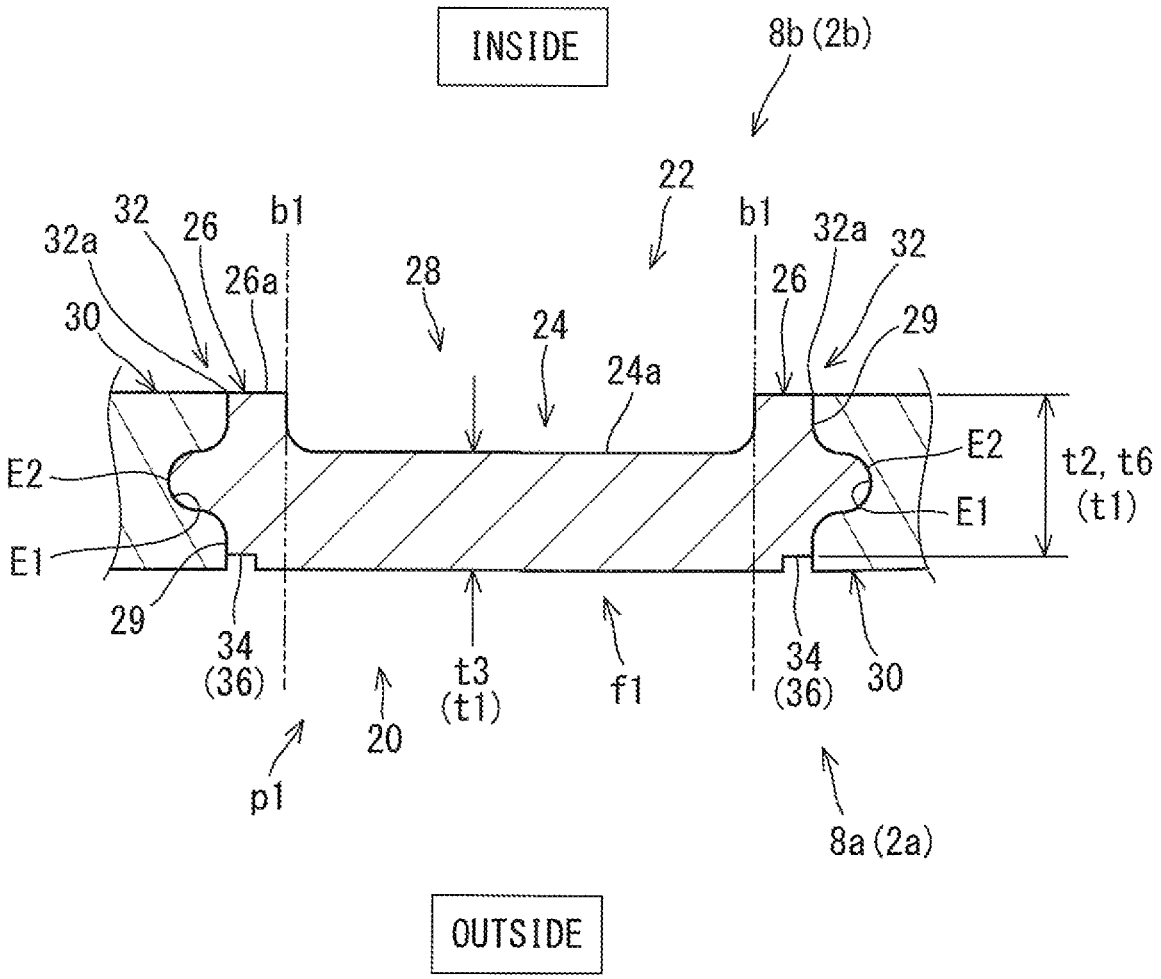
FIG. 5 is an enlarged cross-sectional view of a fixed member and its vicinity in FIG. 3.

FIG. 5 is a cross-sectional view in which a part of FIG. 3 is enlarged. FIG. 5 is an enlarged cross-sectional view of the fixed member f1 and its vicinity.

The inner surface 22 of the fixed member f1 includes a recess 24. This recess 24 is also referred to as an inner-surface recess. The inner-surface recess 24 has a bottom surface 24*a*.

The fixed member f1 includes an outer peripheral portion 26 and an inside region 28. The inside region 28 is a region located inside the outer peripheral portion 26. When the fixed member f1 includes the inner-surface recess 24, the inner-surface recess 24 can define a boundary b1 between the outer peripheral portion 26 and the inside region 28. In FIG. 5, the boundary b1 is indicated with two-dot chain lines. The boundary b1 is a virtual partitioning plane that extends in the up-down direction. A portion located outside the inner-surface recess 24 is the outer peripheral portion 26.

The outer peripheral portion 26 includes an engaging portion E2 that is constituted by at least one projection or recess. The engaging portion E2 of the outer peripheral portion 26 is also referred to as a second engaging portion, which makes a clear distinction from a first engaging portion described below. In the present embodiment, the second engaging portion E2 is a single (one) projection. As indicated with a dashed line in FIG. 2, the second engaging portion E2 is provided continuously over the entire circumference of the outer peripheral portion 26 of the fixed member f1.

The second engaging portion E2 is provided on a side surface 29 of the fixed member f1. The second engaging portion E2 is located at an intermediate position in a thickness direction of the fixed member f1. The second engaging portion E2 is located at an intermediate position in a thickness direction of the sole portion 8. The thickness direction of the sole portion 8 is the up-down direction. The second engaging portion E2 is located apart from the sole outer surface 8*a*. The second engaging portion E2 is located at an upper-side position with respect to the sole outer surface 8*a*. The second engaging portion E2 is located apart from the outer surface 20 of the fixed member f1. The second engaging portion E2 is located at a head inner-side position (an inner-side position in the head) with respect to the outer surface 20. The second engaging portion E2 is located apart from the sole inner surface 8*b*. The second engaging portion E2 is located at a lower-side position with respect to the sole inner surface 8*b*. The second engaging portion E2 is located apart from the inner surface 22 of the fixed member f1. The second engaging portion E2 is located at a head outer-side position (an outer-side position in the head) with respect to the inner surface 22.

The body opening portion p1 of the head body m1 includes an inner peripheral portion 30. The inner peripheral portion 30 includes an engaging portion E1 that is constituted by at least one projection or recess. The engaging portion E1 of the inner peripheral portion 30 is also referred to as a first engaging portion. In the present embodiment, the first engaging portion E1 is a single (one) recess. As indicated with the dashed line in FIG. 2, the first engaging portion E1 is provided continuously over the entire circumference of the inner peripheral portion 30.

The first engaging portion E1 and the second engaging portion E2 form a projection-recess fitting. The projection-recess fitting is formed by the recess and the projection being fitted into the recess. The projection-recess fitting allows the outer peripheral portion 26 and the inner peripheral portion 30 to be joined to each other. As in the present embodiment, when the second engaging portion E2 is a projection, the first engaging portion E1 is a recess. Alternatively, when the second engaging portion E2 is a recess, the first engaging portion E1 is a projection. The projection-recess fitting means a state where a projection(s) is/are fitted into a recess(es).

The projection-recess fitting between the first engaging portion E1 and the second engaging portion E2 is formed by insert casting (casting performed with the presence of an insert placed in a mold in advance). The fixed member f1 is fixed to the head body m1 by the insert casting. The fixed member f1 is integrated into the head body m1 by the insert casting. The projection-recess fitting between the first engaging portion E1 and the second engaging portion E2 is formed by the insert casting of the head body m1 performed with the presence of the fixed member f1 used as the insert. It should be noted that the method for forming the projection-recess fitting is not limited to the insert casting.

Examples of the method other than the insert casting include press-fitting. In addition, as described below, the material of the fixed member need not necessarily be a metal, and thus the projection-recess fitting can be formed by various methods.

As discussed above, at least a part of the outer peripheral portion 26 is joined to the inner peripheral portion 30 of the body opening portion p1. In the present embodiment, the entirety of the outer peripheral portion 26 is joined to the inner peripheral portion 30 of the body opening portion p1. The outer peripheral portion 26 and the inner peripheral portion 30 in the joined state form a joining portion 32.

The joining portion 32 includes an innermost end 32*a*. The innermost end 32*a* is a portion located at the head innermost position in the joining portion 32. In the present embodiment, the innermost end 32*a* is the upper end of the joining portion 32.

The fixed member f1 includes a groove forming portion 34. The groove forming portion 34 is formed on the outer surface 20 of the fixed member f1. The groove forming portion 34 is formed at an edge portion of the outer surface 20. A groove 36 is formed by a combination of the groove forming portion 34 and the inner peripheral portion 30 adjacent to the groove forming portion 34. A filling material can be disposed in the groove 36. Such a filling material can improve the appearance of the boundary between the fixed member f1 and the head body m1. The filling material can be a coating material. The coating material can emphasize the presence of the fixed member f1 and/or improve the design aesthetics of the head. By providing the groove forming portion 34 in the fixed member f1, not in the head body m1, the strength deterioration of the head body m1 can be prevented.

The material of the head body m1 is different from the material of the fixed member f1. The head body m1 is formed by a first material that has a first specific gravity. The fixed member f1 is formed by a second material having a second specific gravity. The first specific gravity is different from the second specific gravity. The first material is different from the second material.

In the present embodiment, the fixed member f1 is a weight member. In the present embodiment, the second specific gravity is higher than the first specific gravity. Providing the fixed member f1 having a higher specific gravity in the sole portion 8 can lower the position of the center of gravity of the head 2.

In the head 2, the inner surface of the inside region 28 is the bottom surface 24*a* of the inner-surface recess 24. As shown in FIG. 5, the bottom surface 24*a* is located at a head outer-side position with respect to an innermost end 26*a* of the outer peripheral portion 26. The bottom surface 24*a* is located at a head outer-side position with respect to the innermost end 32*a* of the joining portion 32.

When the fixed member f1 is disposed in the sole portion 8, the innermost end 26*a* of the outer peripheral portion 26 is the upper end of the outer peripheral portion 26. In contrast, when the fixed member f1 is disposed in the crown portion 6, the innermost end of the outer peripheral portion is the lower end of the outer peripheral portion. When the fixed member f1 is disposed in the sole portion 8, the term "head outer side or head outward" means the lower side or downward of the head. In contrast, when the fixed member f1 is disposed in the crown portion 6, the term "head outer side or head outward" means the upper side or upward of the head. In the head 2, the inner surface 24*a* of the inside region 28 is located at a lower-side position with respect to the upper end 26*a* of the outer peripheral portion 26.

When the fixed member f1 is disposed in the sole portion 8, the innermost end 32*a* of the joining portion 32 is the upper end of the joining portion 32. In contrast, when the fixed member f1 is disposed in the crown portion 6, the innermost end of the joining portion is the lower end of the joining portion. In the head 2, the inner surface 24*a* of the inside region 28 is located on the lower side with respect to the upper end 32*a* of the joining portion 32.

Figure 6:
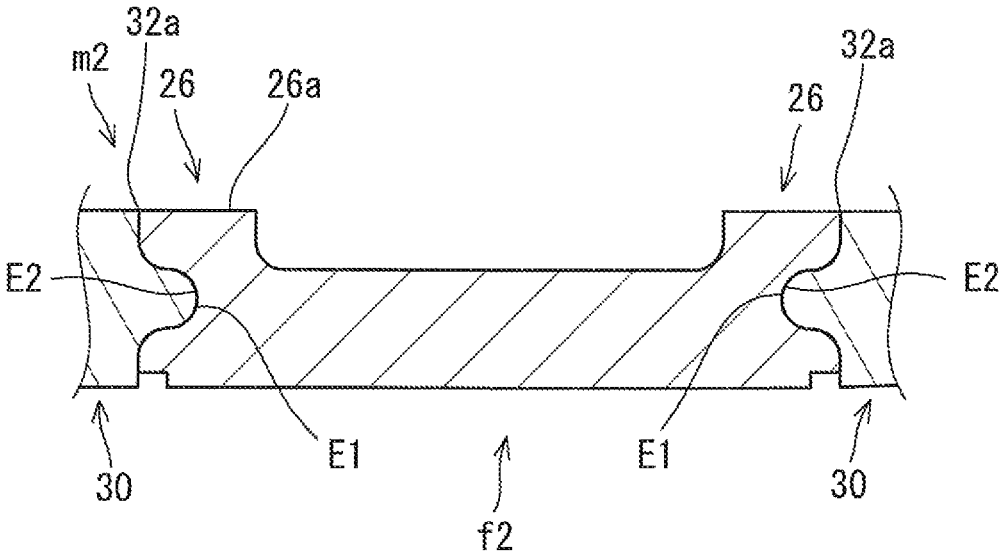
FIG. 6 is an enlarged cross-sectional view of a fixed member and its vicinity in a head according to a second embodiment.

FIG. 6 is a cross-sectional view showing a fixed member f2 and its vicinity in a head according to a second embodiment. This head includes a head body m2 and the fixed member f2. In the second embodiment, a second engaging portion E2 of an outer peripheral portion 26 is constituted by a recess, and a first engaging portion E1 of an inner peripheral portion 30 is constituted by a projection. Except for these portions, the head of the second embodiment is the same as the head 2 of the first embodiment. As in this embodiment, in the projection-recess fitting formed by the first engaging portion E1 and the second engaging portion E2, the first engaging portion E1 of the head body m2 may be a projection and the second engaging portion E2 of the fixed member f2 may be a recess.

Figure 7:
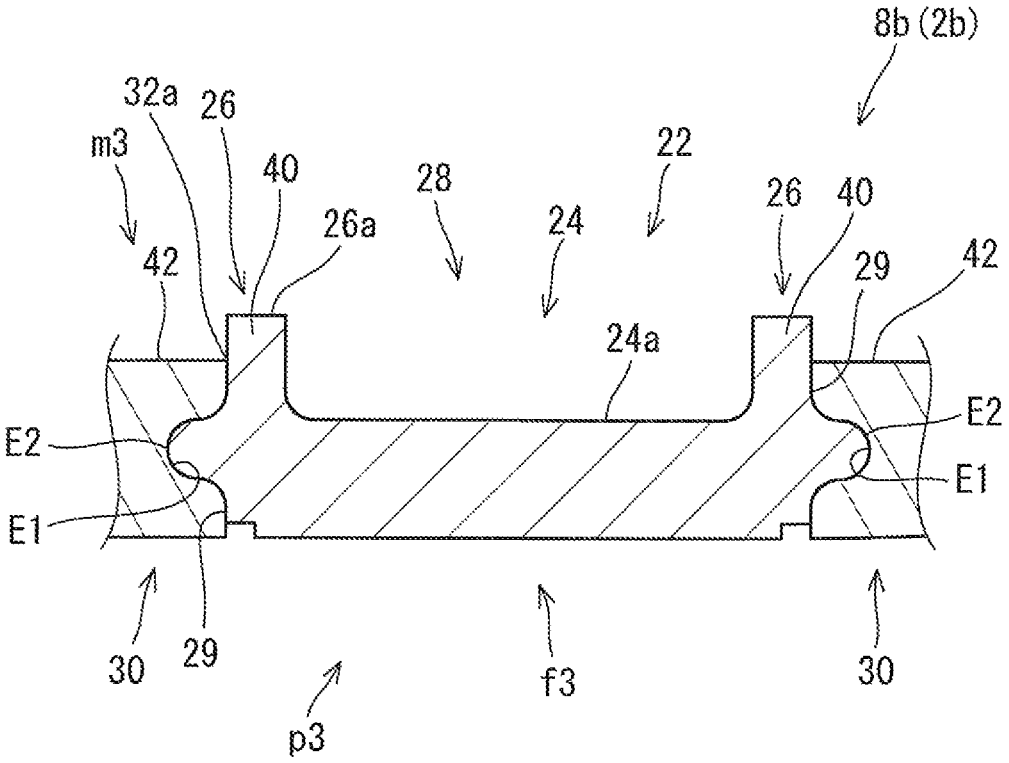
FIG. 7 is an enlarged cross-sectional view of a fixed member and its vicinity in a head according to a third embodiment.

FIG. 7 is a cross-sectional view showing a fixed member f3 and its vicinity in a head according to a third embodiment. This head includes a head body m3 and the fixed member f3.

The fixed member f3 has an inner surface 22 that includes an inner-surface recess 24. The inner-surface recess 24 has a bottom surface 24*a*. The fixed member f3 includes an outer peripheral portion 26 and an inside region 28. The outer peripheral portion 26 includes a second engaging portion E2 that is constituted by a projection. The second engaging portion E2 is provided on a side surface 29 of the fixed member f3.

The head body m3 has a body opening portion p3 that includes an inner peripheral portion 30. The inner peripheral portion 30 includes a first engaging portion E1 that is constituted by a recess. The first engaging portion E1 and the second engaging portion E2 form a projection-recess fitting. The projection-recess fitting allows the outer peripheral portion 26 and the inner peripheral portion 30 to be joined to each other.

An inward extending portion 40 is provided on the inner surface of the fixed member f3. The inward extending portion 40 is provided in the outer peripheral portion 26. The inner surface of the head body m3 includes an adjacent inner surface 42 that is adjacent to the fixed member f3 (inward extending portion 40). The inward extending portion 40 is projected further inward of the head than the adjacent inner surface 42. When the fixed member f1 is disposed in the sole portion 8, the term "inward of the head" means upward. In the present embodiment, the inward extending portion 40 is projected further upward than the adjacent inner surface 42. Except for the presence of the inward extending portion 40, the head of the third embodiment is the same as the head 2 of the first embodiment. The inward extending portion 40 improves the degree of freedom in the design of the position of the center of gravity of the head.

Figure 8:
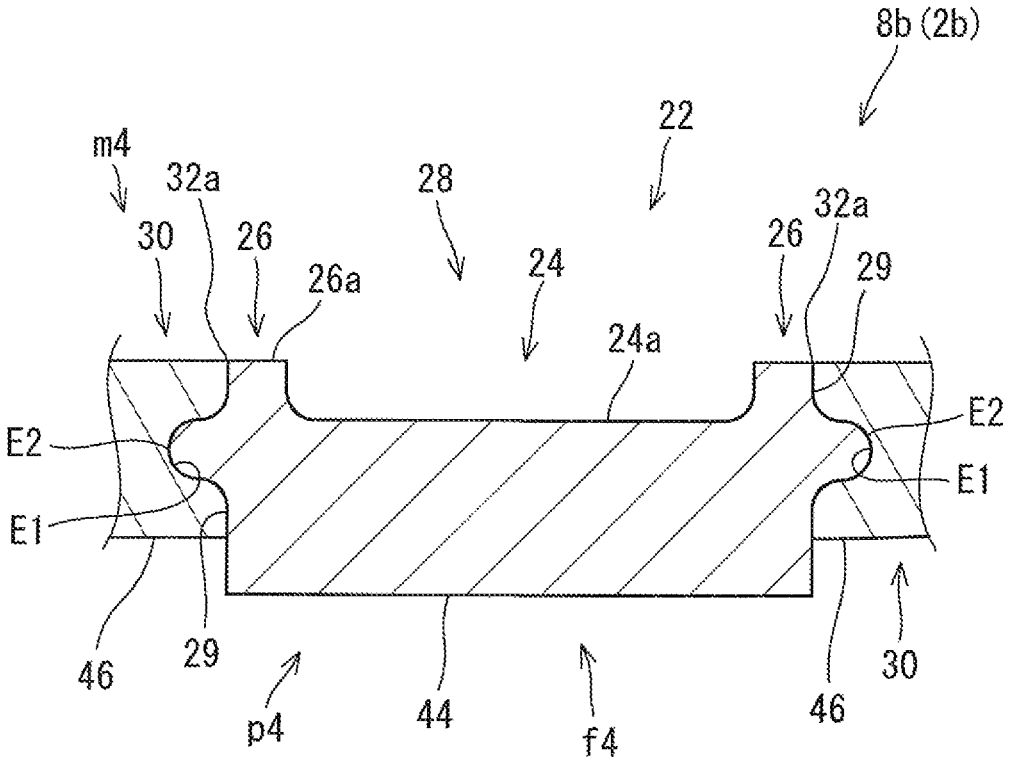
FIG. 8 is an enlarged cross-sectional view of a fixed member and its vicinity in a head according to a fourth embodiment.

FIG. 8 is a cross-sectional view showing a fixed member f4 and its vicinity in a head according to a fourth embodiment. This head includes a head body m4 and the fixed member f4.

The fixed member f4 has an inner surface 22 that includes an inner-surface recess 24. The inner-surface recess 24 has a bottom surface 24*a*. The fixed member f4 includes an outer peripheral portion 26 and an inside region 28. The outer peripheral portion 26 includes a second engaging portion E2 that is constituted by a projection. The second engaging portion E2 is provided on a side surface 29 of the fixed member f4.

The head body m4 has a body opening portion p4 that includes an inner peripheral portion 30. The inner peripheral portion 30 includes a first engaging portion E1 that is constituted by a recess. The first engaging portion E1 and the second engaging portion E2 form a projection-recess fitting. The projection-recess fitting allows the outer peripheral portion 26 and the inner peripheral portion 30 to be joined to each other.

An outward extending portion 44 is provided on the outer surface of the fixed member f4. The outward extending portion 44 is formed such that the outward extending portion 44 extends over the outer peripheral portion 26 and the inside region 28. Alternatively, the outward extending portion 44 may be formed only on the outer peripheral portion 26. Alternatively, the outward extending portion 44 may be formed only on the inside region 28. The outer surface of the head body m4 includes an adjacent outer surface 46 that is adjacent to the fixed member f4 (outward extending portion 44). The outward extending portion 44 is projected further outward of the head than the adjacent outer surface 46. When the fixed member f4 is disposed in the sole portion 8, the term "outward of the head" means downward. In the present embodiment, the outward extending portion 44 is projected further downward than the adjacent outer surface 46. Except for the presence of the outward extending portion 44, the head of the fourth embodiment is the same as the head 2 of the first embodiment. The outward extending portion 44 improves the degree of freedom in the design of the position of the center of gravity of the head.

Figure 9:
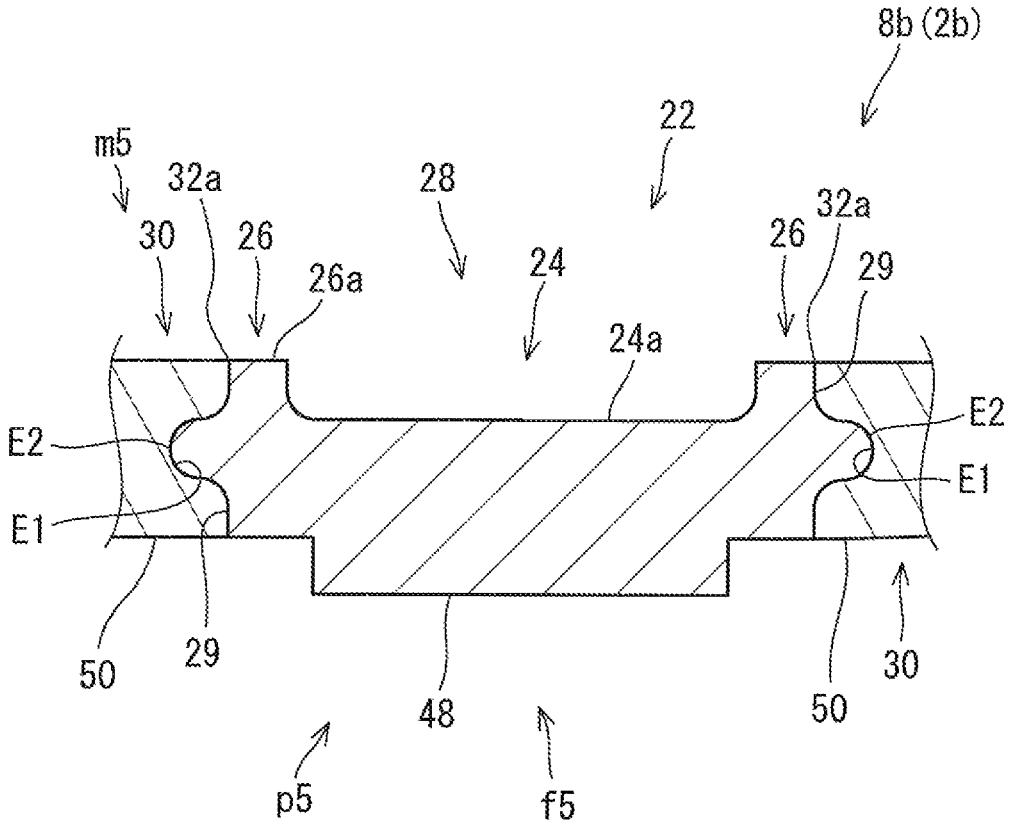
FIG. 9 is an enlarged cross-sectional view of a fixed member and its vicinity in a head according to a fifth embodiment.

FIG. 9 is a cross-sectional view showing a fixed member f5 and its vicinity in a head according to a fifth embodiment. This head includes a head body m5 and the fixed member f5.

The fixed member f5 has an inner surface 22 that includes an inner-surface recess 24. The inner-surface recess 24 has a bottom surface 24*a*. The fixed member f5 includes an outer peripheral portion 26 and an inside region 28. The outer peripheral portion 26 includes a second engaging portion E2 that is constituted by a projection. The second engaging portion E2 is provided on a side surface 29 of the fixed member f5.

The head body m5 has a body opening portion p5 that includes an inner peripheral portion 30. The inner peripheral portion 30 includes a first engaging portion E1 that is constituted by a recess. The first engaging portion E1 and the second engaging portion E2 form a projection-recess fitting. The projection-recess fitting allows the outer peripheral portion 26 and the inner peripheral portion 30 to be joined to each other.

An outward extending portion 48 is provided on the outer surface of the fixed member f5. The outward extending portion 48 is formed on the inside region 28 (only). The outward extending portion 48 is not formed on the outer peripheral portion 26. The outer surface of the head body m5 includes an adjacent outer surface 50 that is adjacent to the fixed member f5. The outward extending portion 48 is projected further outward of the head than the adjacent outer surface 50. The outward extending portion 48 is projected further downward than the adjacent outer surface 50. Except for the presence of the outward extending portion 48, the head of the fifth embodiment is the same as the head 2 of the first embodiment. The outward extending portion 48 improves the degree of freedom in the design of the position of the center of gravity of the head.

Figure 10:
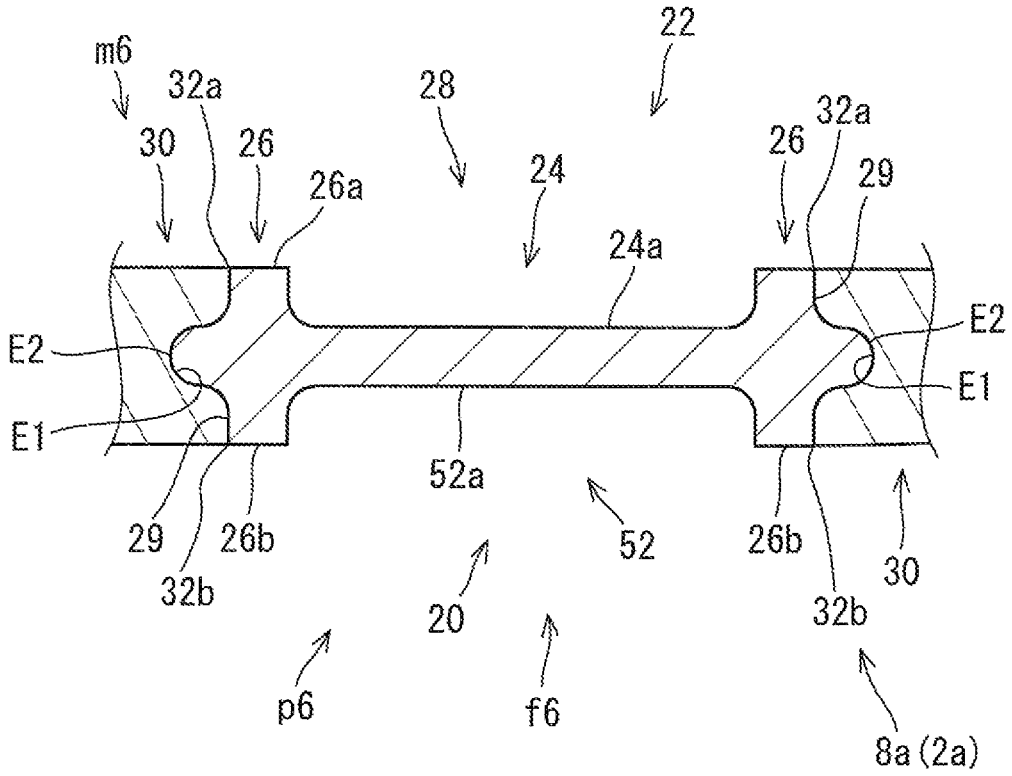
FIG. 10 is an enlarged cross-sectional view of a fixed member and its vicinity in a head according to a sixth embodiment.

FIG. 10 is a cross-sectional view showing a fixed member f6 and its vicinity in a head according to a sixth embodiment. This head includes a head body m6 and the fixed member f6.

The fixed member f6 has an inner surface 22 that includes an inner-surface recess 24. The inner-surface recess 24 has a bottom surface 24*a*. The fixed member f6 includes an outer peripheral portion 26 and an inside region 28. The outer peripheral portion 26 includes a second engaging portion E2 that is constituted by a projection. The second engaging portion E2 is provided on a side surface 29 of the fixed member f6.

The head body m6 has a body opening portion p6 that includes an inner peripheral portion 30. The inner peripheral portion 30 includes a first engaging portion E1 that is constituted by a recess. The first engaging portion E1 and the second engaging portion E2 form a projection-recess fitting. The projection-recess fitting allows the outer peripheral portion 26 and the inner peripheral portion 30 to be joined to each other.

The fixed member f6 has an outer surface 20 that includes a recess 52. This recess 52 is also referred to as an outer-surface recess. The outer-surface recess 52 has a bottom surface 52*a*. The outer-surface recess 52 is provided in the inside region 28. Alternatively, the outer-surface recess 52 may be provided over the outer peripheral portion 26 and the inside region 28. The bottom surface 52*a* is the outer surface of the inside region 28. The outer surface 52*a* of the inside region 28 is located on the upper side with respect to the lower end 26*b* of the outer peripheral portion 26. The outer surface 52*a* of the inside region 28 is located on the upper side with respect to the lower end 32*b* of the joining portion 32. Except for the presence of the outer-surface recess 52, the head of the sixth embodiment is the same as the head 2 of the first embodiment. The outer-surface recess 52 improves the degree of freedom in the design of the position of the center of gravity of the head.

Figure 11:
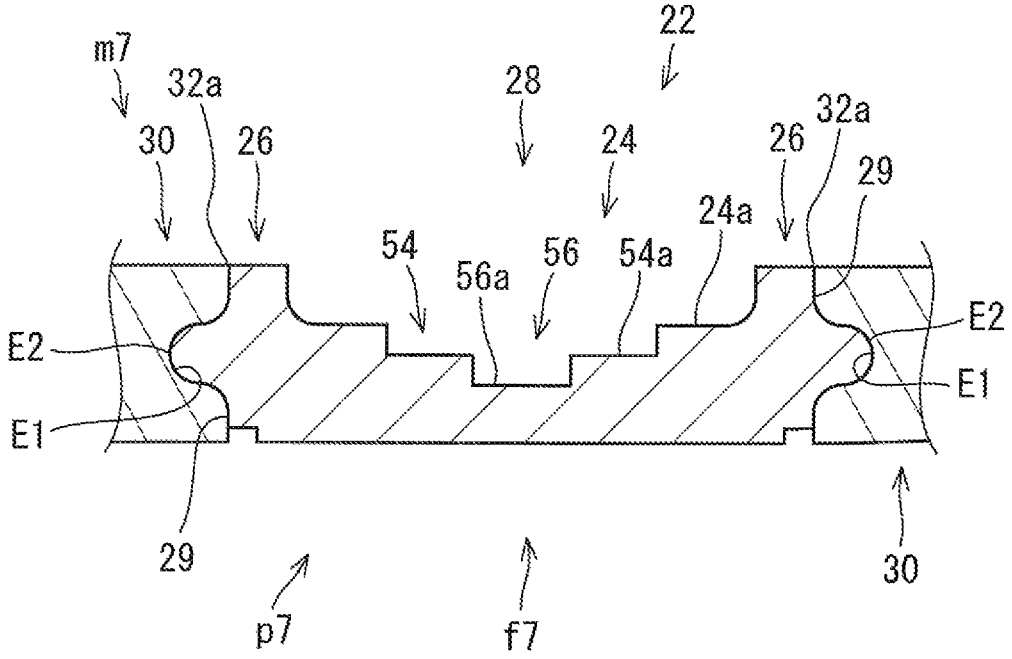
FIG. 11 is an enlarged cross-sectional view of a fixed member and its vicinity in a head according to a seventh embodiment.

FIG. 11 is a cross-sectional view showing a fixed member f7 and its vicinity in a head according to a seventh embodiment. This head includes a head body m7 and the fixed member f7.

The fixed member f7 has an inner surface 22 that includes an inner-surface recess 24. The inner-surface recess 24 has a bottom surface 24*a*. The fixed member f7 includes an outer peripheral portion 26 and an inside region 28. The outer peripheral portion 26 includes a second engaging portion E2 that is constituted by a projection. The second engaging portion E2 is provided on a side surface 29 of the fixed member f7.

The head body m7 has a body opening portion p7 that includes an inner peripheral portion 30. The inner peripheral portion 30 includes a first engaging portion E1 that is constituted by a recess. The first engaging portion E1 and the second engaging portion E2 form a projection-recess fitting. The projection-recess fitting allows the outer peripheral portion 26 and the inner peripheral portion 30 to be joined to each other.

The bottom surface 24*a* of the inner-surface recess 24 includes a recess 54. The recess 54 is an inner-surface recess provided on the bottom surface 24*a* of the inner surface recess 24. This inner-surface recess 54 has a bottom surface 54*a*. The bottom surface 54*a* is located at a head outer-side position with respect to the bottom surface 24*a*. The bottom surface 54*a* is located on the lower side with respect to the bottom surface 24*a*. The bottom surface 54*a* of the inner-surface recess 54 includes a recess 56. The recess 56 is an inner-surface recess provided in the inner-surface recess 54. The inner-surface recess 56 has a bottom surface 56*a*. The bottom surface 56*a* is located at a head outer-side position with respect to the bottom surface 54*a*. The bottom surface 56*a* is located on the lower side with respect to the bottom surface 54*a*. Except for the presence of the inner-surface recess 54 and the inner-surface recess 56, the head of the seventh embodiment is the same as the head 2 of the first embodiment.

As discussed above, the number of the inner-surface recess(es) may be two or more. As in the fixed member f7, a plurality of inner-surface recesses may be provided such that an inner-surface recess is disposed inside another inner-surface recess. Alternatively, a plurality of inner-surface recesses may be separately provided at respective positions different from each other. The weight distribution of the fixed member can be finely changed by using such a plurality of inner-surface recesses. Therefore, the center of gravity of the head can be finely adjusted.

Figure 12:
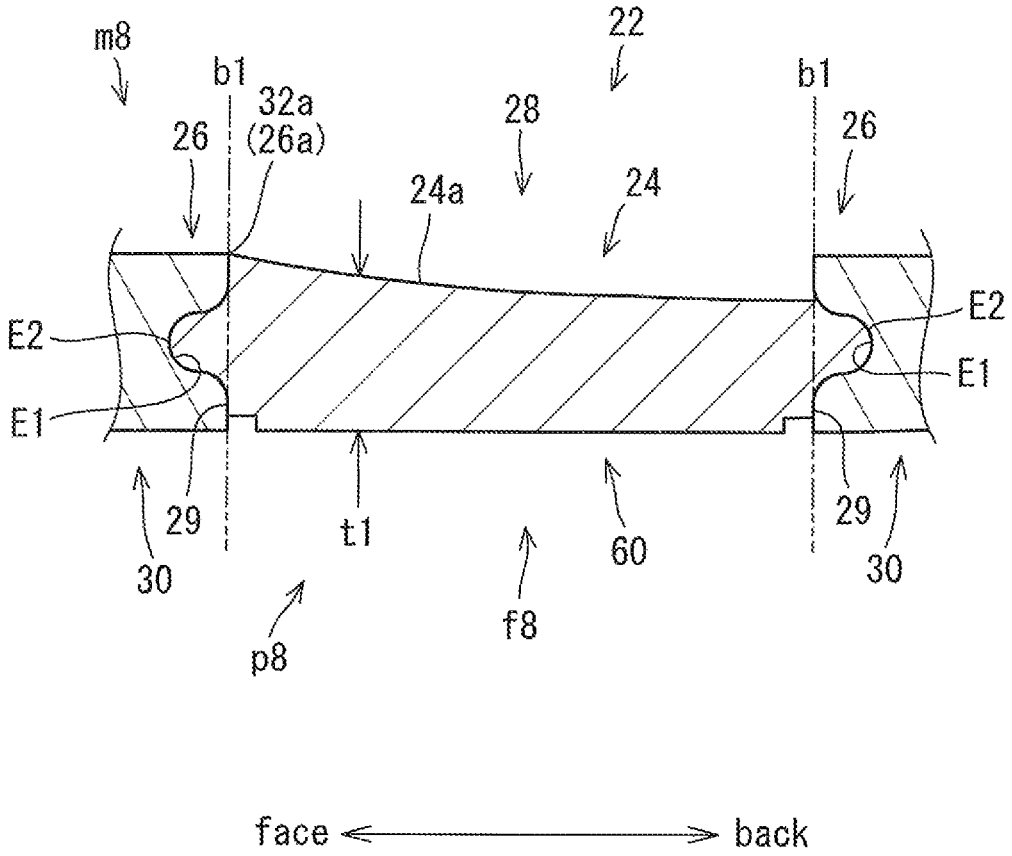
FIG. 12 is an enlarged cross-sectional view of a fixed member and its vicinity in a head according to an eighth embodiment.

FIG. 12 is a cross-sectional view showing a fixed member f8 and its vicinity in a head according to an eighth embodiment. This head includes a head body m8 and the fixed member f8.

The fixed member f8 has an inner surface 22 that includes an inner-surface recess 24. The inner-surface recess 24 has a bottom surface 24*a*. The fixed member f8 includes an outer peripheral portion 26 and an inside region 28. The inside region 28 is a region located inside the outer peripheral portion 26. As discussed above, when the fixed member f8 includes the inner-surface recess 24, the inner-surface recess 24 can define a boundary b1 between the outer peripheral portion 26 and the inside region 28. In FIG. 12, the boundary b1 is indicated with two-dot chain lines. A portion located outside the inner-surface recess 24 is the outer peripheral portion 26.

The outer peripheral portion 26 includes a second engaging portion E2 that is constituted by a projection. The second engaging portion E2 is provided on a side surface 29 of the fixed member f8. In the present embodiment, the outer peripheral portion 26 is constituted by the side surface 29 and the second engaging portion E2.

The head body m8 has a body opening portion p8 that includes an inner peripheral portion 30. The inner peripheral portion 30 includes a first engaging portion E1 that is constituted by a recess. The first engaging portion E1 and the second engaging portion E2 form a projection-recess fitting. The projection-recess fitting allows the outer peripheral portion 26 and the inner peripheral portion 30 to be joined to each other.

The depth of the inner-surface recess 24 becomes shallower toward the face side. The fixed member f8 includes a thickness changing portion 60 having a thickness t1 that increases toward the face side. The inner-surface recess 24 forms the thickness changing portion 60. The thickness t1 is measured in the up-down direction.

The above-described first to eighth embodiments exhibit the following advantageous effects.

Since the fixed member and the body opening portion are mechanically joined to each other by the projection-recess fitting, the joining strength between the two can be increased. In some cases, weldability between the fixed member and the head body might be poor even when the fixed member is made of a metal and the head body is also made of a metal. Even in such cases, the projection-recess fitting enables the fixed member and the head body to be joined to each other.

In the above-described embodiments, the fixed member is disposed in the sole portion 8. The inner surface 24*a* of the inner-surface recess 24 is located on the lower side with respect to the upper end 26*a* of the outer peripheral portion 26. For this reason, when the fixed member is a weight member having a high specific gravity, the weight member can be located at a lower-side position in the head, which can lower the position of the center of gravity of the head.

When the fixed member is disposed in the sole portion 8, the inner-surface recess 24 can lower the position of the center of gravity of the head. When the fixed member is disposed in the crown portion 6, the inner-surface recess 24 can raise the position of the center of gravity of the head. Regardless of the position of the fixed member, the inner-surface recess 24 can locate the position of the center of gravity of the fixed member at a head outer-side position, which can increase the moment of inertia of the head about the center of gravity of the head. As shown in FIG. 13A to FIG. 13D explained below, the position of the center of gravity of the head can be adjusted by choosing the position of the inner-surface recess 24.

Normally, when the difference between the specific gravity of the material of the fixed member and the specific gravity of the material of the head body is large, the weldability between the two becomes poor. The projection-recess fitting, however, enables the fixed member and the head body to be joined to each other even when the difference in specific gravity between the two is large. For this reason, the fixed member may be a weight member having a larger weight, whereby the position of the center of gravity of the head can be effectively lowered, for example. Alternatively, the fixed member may be lightweight, and a weight saved by using the lightweight fixed member (hereinafter referred to as "saved weight") can be redistributed to other location(s) of the head, for example. An increase in the difference between the specific gravity of the fixed member and the specific gravity of the head body can enhance the degree of freedom in the design of the head.

In the above-described embodiments, a part of the sole portion 8 is substituted with the fixed member. The outer surface 20 of the fixed member forms a part of the sole outer surface 8*a* (outer surface 2*a* of the head 2), and the inner surface 22 of the fixed member forms a part of the sole inner surface 8*b* (inner surface 2*b* of the head 2). The fixed member is not supported by the head body from the inside of the head. The fixed member penetrates through the sole portion 8. The fixed member occupies the whole sole portion 8 in the thickness direction. A part of the sole portion 8 (wall portion that forms the outer surface 2*a* and the inner surface 2*b* of the head 2) is formed by the fixed member only. This structure further enhances the advantageous effects brought by the difference in specific gravity between the head body and the fixed member. That is, when the fixed member is a weight member, the weight of a region where the fixed member is disposed can be increased. Accordingly, when the weight member is disposed in the sole portion 8, the advantageous effect of lowering the center of gravity of the head is enhanced. In contrast, when the fixed member is a lightweight member, the weight of a region where the fixed member is disposed can be decreased. Accordingly, the reduced weight can increase the amount of the saved weight to be redistributed to other location(s).

Figure 13A:
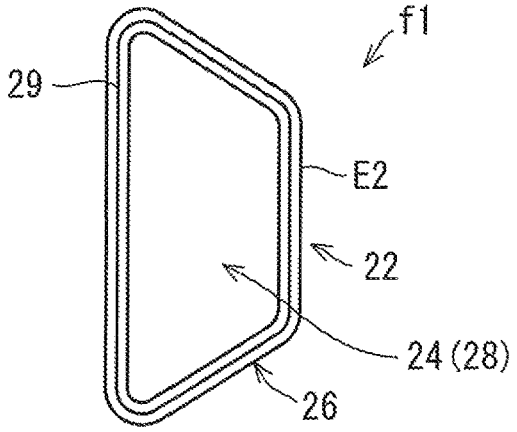
FIG. 13A is a plan view of the fixed member according to the first embodiment as viewed from inside the head.

FIG. 13A is a plan view of the fixed member f1 according to the first embodiment. FIG. 13A is a plan view of the fixed member f1 as viewed from above (from the hollow interior k1 side). As described above, the second engaging portion E2 of the fixed member f1 extends over the entire circumference of the outer peripheral portion 26.

Figure 13B:
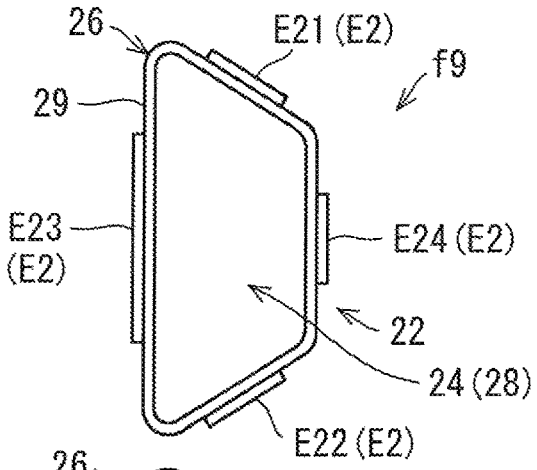
FIG. 13B is a plan view of a fixed member according to a nineth embodiment as viewed from inside the head.

FIG. 13B is a plan view of a fixed member f9 according to a nineth embodiment. Four second engaging portions E2

(E21, E22, E23 and E24) are provided on the fixed member f9. In other words, the second engaging portions E2 are disposed at four respective positions spaced apart from each other. The second engaging portion E21 is provided on the side surface 29 on the toe side of the outer peripheral portion 26. The second engaging portion E22 is provided on the side surface 29 on the heel side of the outer peripheral portion 26. The second engaging portion E23 is provided on the side surface 29 on the face side of the outer peripheral portion 26. The second engaging portion E24 is provided on the side surface 29 on the back side of the outer peripheral portion 26. First engaging portions corresponding to the respective second engaging portions E21 to E24 are provided on the head body. Except for the above-described features, the fixed member f9 is the same as the fixed member f1 of the first embodiment. In the fixed member f9, the second engaging portions E2 are provided partially on the outer peripheral portion 26. Therefore, in the fixed member f9, some parts of the outer peripheral portion 26, not its entirety, are joined to the inner peripheral portion 30.

Figure 13C:
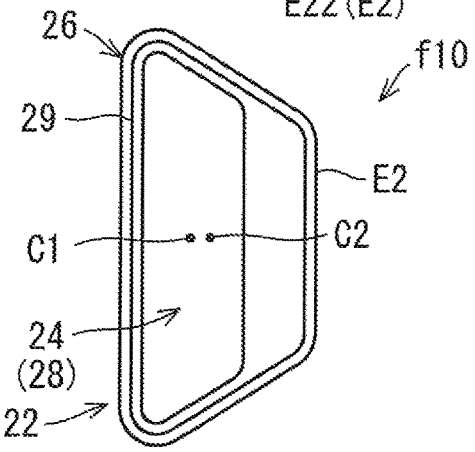
FIG. 13C is a plan view of a fixed member according to a tenth embodiment as viewed from inside the head.

FIG. 13C is a plan view of a fixed member f10 according to a tenth embodiment. The fixed member f10 includes an inner-surface recess 24 that is unevenly disposed only on the face side. The geometric center C1 of the inner-surface recess 24 does not coincide with the geometric center C2 of the inner surface 22 of the fixed member f10. The geometric center C1 of the inner-surface recess 24 is located on the face side relative to the geometric center C2 of the inner surface 22. This structure allows the center of gravity of the fixed member f10 to be located at a further back-side position, whereby the position of the center of gravity of the head can be located at a deeper position (further back-side position). The geometric center C1 of the inner-surface recess 24 means the geometric center (center of figure) of the contour line of the inner-surface recess 24 in the planar view. The geometric center C2 of the inner surface 22 means the geometric center (center of figure) of the contour line of the inner surface 22 in the planar view.

Figure 13D:
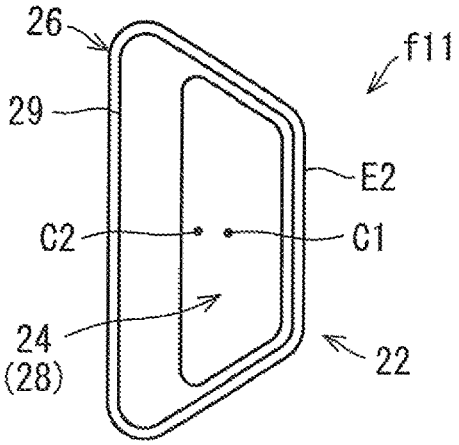
FIG. 13D is a plan view of a fixed member according to an eleventh embodiment as viewed from inside the head.

FIG. 13D is a plan view of a fixed member f11 according to an eleventh embodiment. The fixed member f11 includes an inner-surface recess 24 that is unevenly disposed only on the back side. The geometric center C1 of the inner-surface recess 24 does not coincide with the geometric center C2 of the inner surface 22 of the fixed member f11. The geometric center C1 of the inner-surface recess 24 is located on the back side relative to the geometric center C2 of the inner surface 22. This structure allows the center of gravity of the fixed member f11 to be located at a further face-side position, whereby the position of the center of gravity of the head can be located at a shallower position (further face-side position).

Twelfth Embodiment

Figure 14:
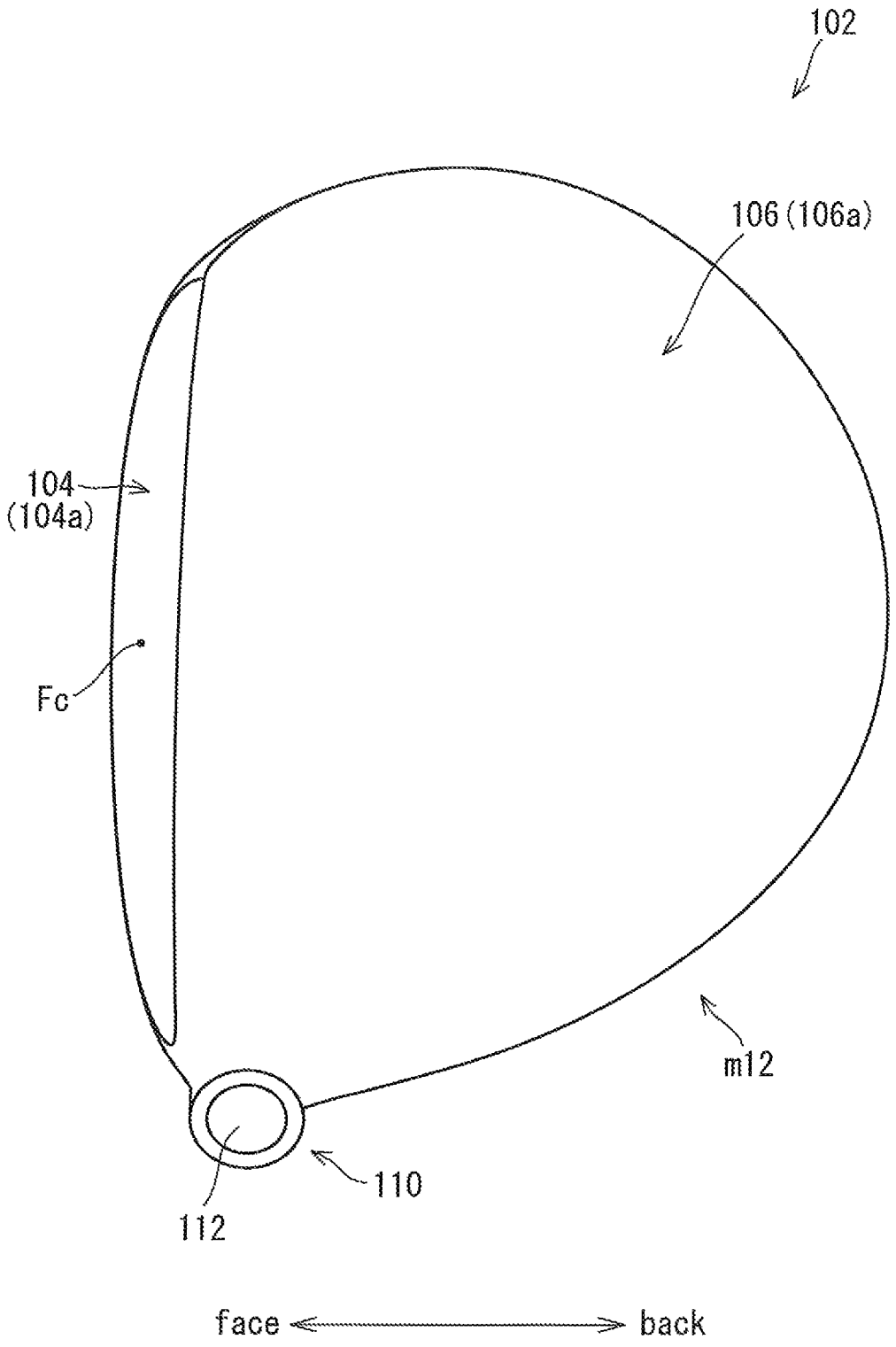
FIG. 14 is a plan view of a golf club head according to a twelfth embodiment.
Figure 15:
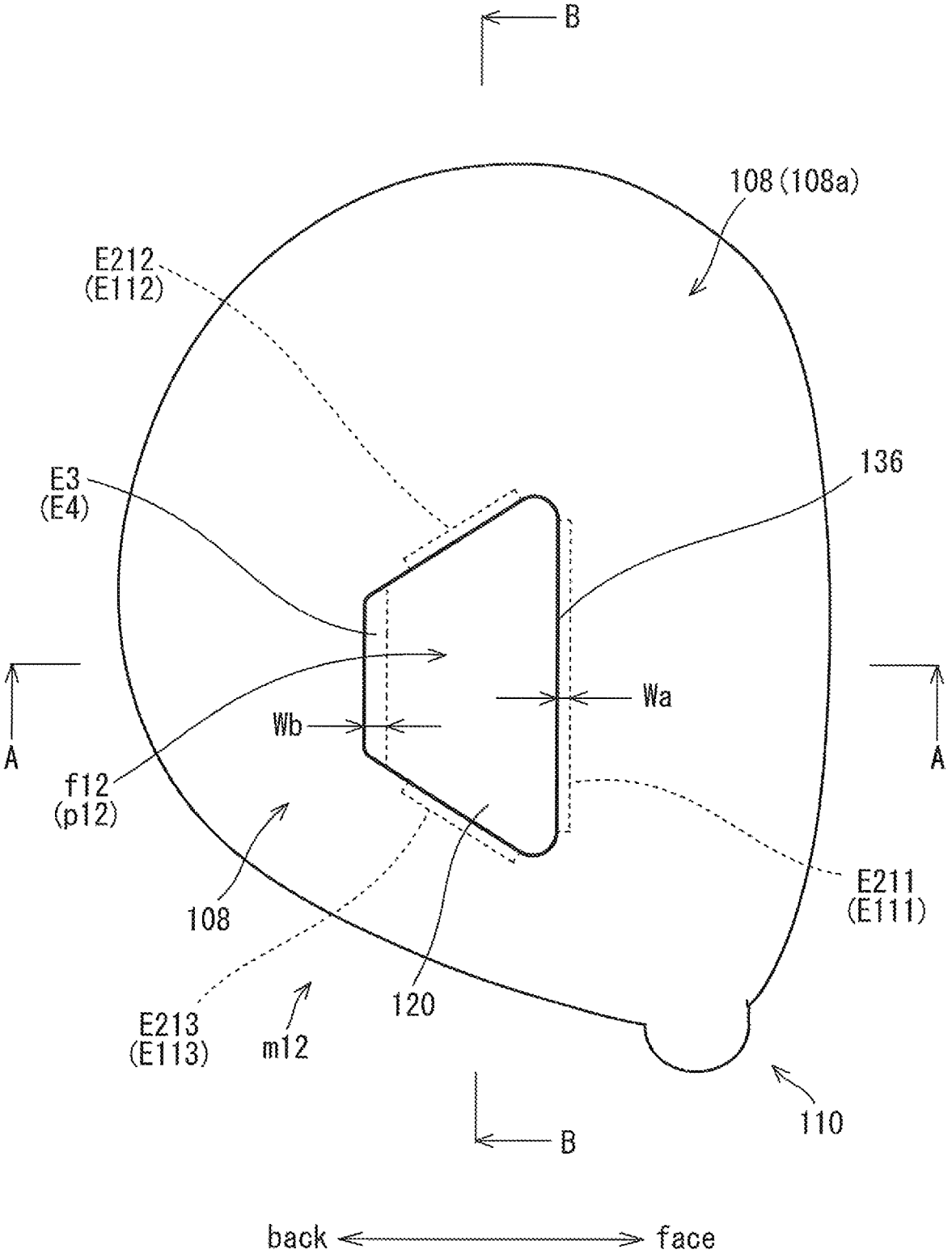
FIG. 15 is a bottom view of the head in FIG. 14.
Figure 16:
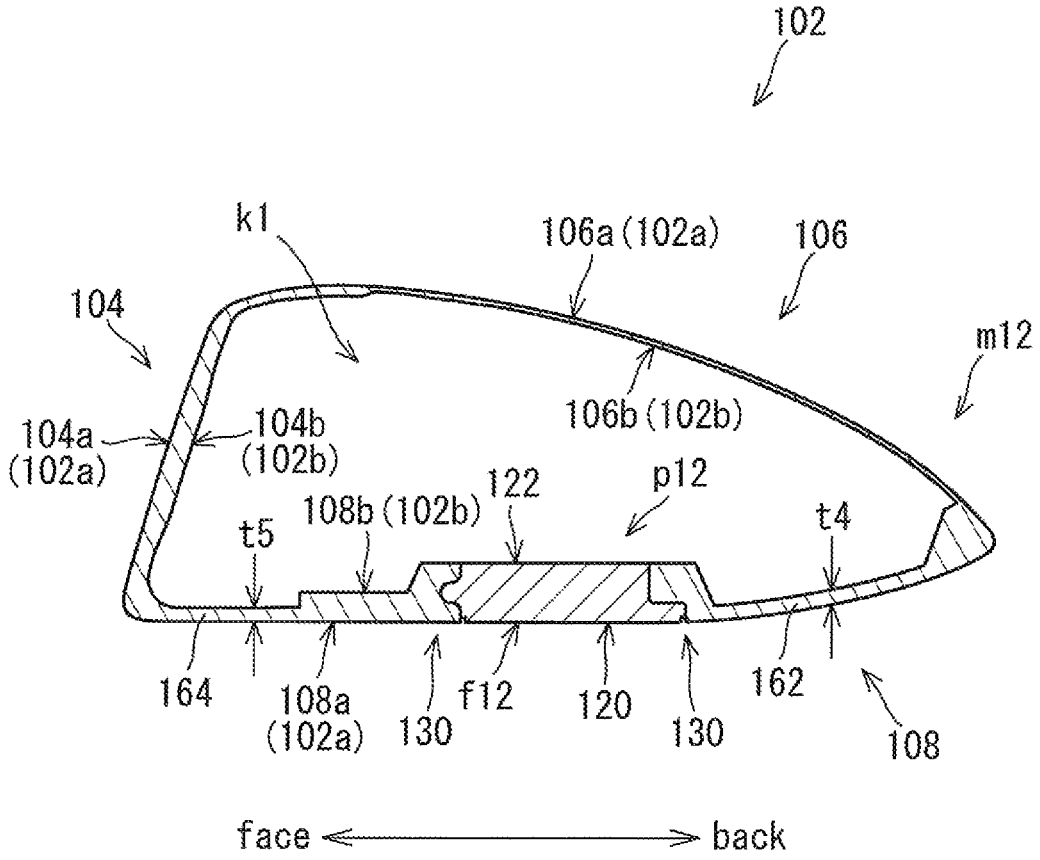
FIG. 16 is a cross-sectional view taken along line A-A in FIG. 15.
Figure 17:
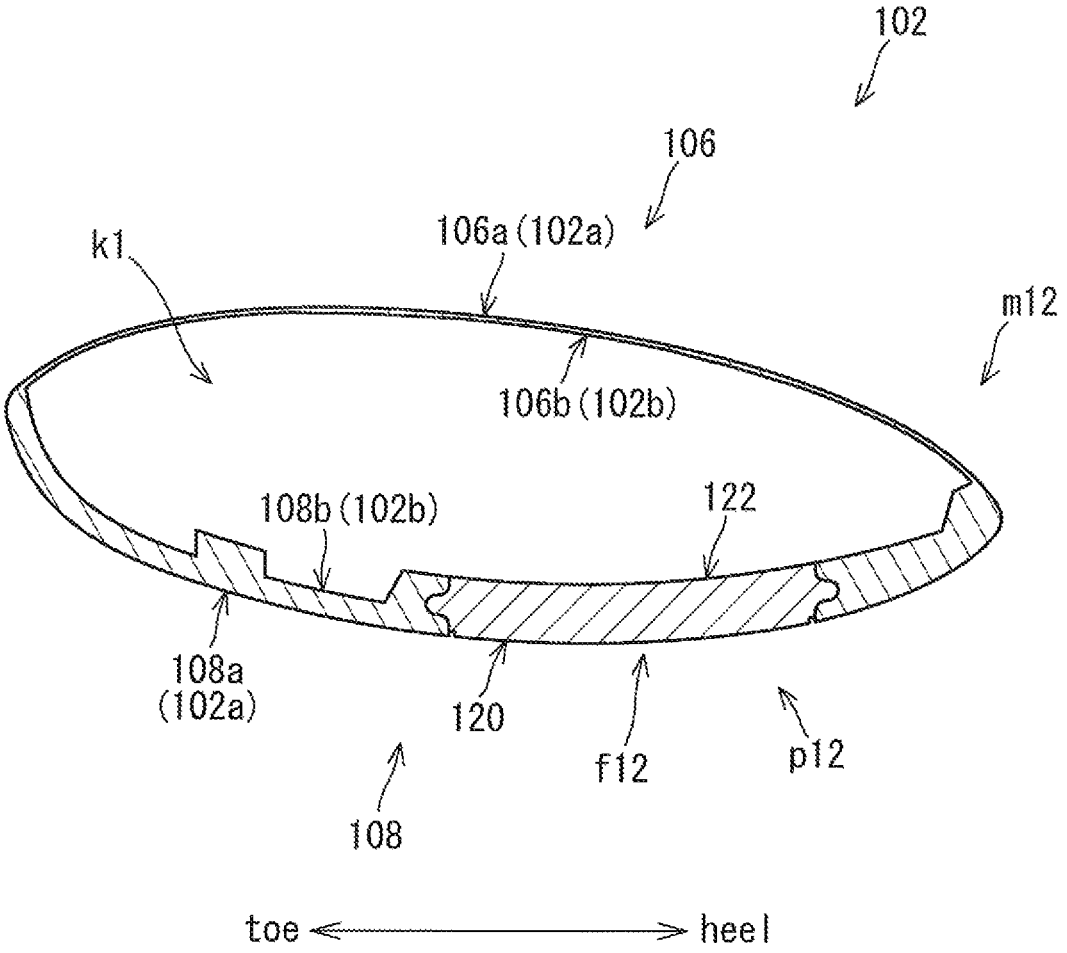
FIG. 17 is a cross-sectional view taken along line B-B in FIG. 15.

FIG. 14 is a plan view of a golf club head 102 according to a twelfth embodiment. FIG. 15 is a bottom view of the head 102. FIG. 16 is a cross-sectional view taken along line A-A in FIG. 15. FIG. 17 is a cross-sectional view taken along line B-B in FIG. 15.

The head 102 includes a hitting face portion 104, a crown portion 106, a sole portion 108 and a hosel portion 110. The hosel portion 110 includes a hosel hole 112.

The head 102 is a wood type head. The head 102 is a fairway wood type head. Examples of the head 102 include a fairway wood type head, a hybrid type head, a driver head, and an iron type head.

As shown in FIG. 16 and FIG. 17, the head 102 includes a hollow interior k1. The head 102 is a hollow golf club head.

The hitting face portion 104 includes a face outer surface 104*a* and a face inner surface 104*b*. The face outer surface 104*a* forms a part of an outer surface 102*a* of the head 102. The face outer surface 104*a* is also referred to as a face surface. The face outer surface 104*a* has a face center Fc. The face inner surface 104*b* forms a part of an inner surface 102*b* of the head 102. The face inner surface 104*b* faces the hollow interior k1. The crown portion 106 includes a crown outer surface 106*a* and a crown inner surface 106*b*. The crown outer surface 106*a* forms a part of the outer surface 102*a* of the head 102. The crown inner surface 106*b* forms a part of the inner surface 102*b* of the head 102. The crown inner surface 106*b* faces the hollow interior k1. The sole portion 108 includes a sole outer surface 108*a* and a sole inner surface 108*b*. The sole outer surface 108*a* forms a part of the outer surface 102*a* of the head 102. The sole inner surface 108*b* forms a part of the inner surface 102*b* of the head 102. The sole inner surface 108*b* faces the hollow interior k1.

The head 102 includes a head body m12 and a fixed member f12. The head body m12 forms the entirety of the hitting face portion 104. The head body m12 forms the entirety of the crown portion 106. The head body m12 forms a part of the sole portion 108. The sole portion 108 is constituted by the head body m12 and the fixed member f12. The head body m12 forms the entirety of the hosel portion 110.

The head body m12 has an opening portion p12. The opening portion p12 is also referred to as a body opening portion. The body opening portion p12 is provided in the sole portion 108. The body opening portion p12 forms a through hole that penetrates through a wall of the head body m12. The body opening portion p12 forms the through hole that penetrates through the wall of the head body m12 from the outer surface 102*a* of the head 102 to the inner surface 102*b* of the head 102. The body opening portion p12 forms the through hole that penetrates through the wall of the head body m12 from the outside of the head 102 to the hollow interior k1. The body opening portion p12 forms the through hole that penetrates through the sole portion 108. The body opening portion p12 forms the through hole that penetrates through the sole portion 108 from the sole outer surface 108*a* to the sole inner surface 108*b*.

The fixed member f12 is fixed to the head body m12. The fixed member f12 is not welded to the head body m12. The fixed member f12 is not glued to the head body m12. The method for fixing the fixed member f1 is described below. The fixed member f12 is located inside the body opening portion p12. The fixed member f12 is fixed to the inside of the body opening portion p12. The fixed member f12 blocks the through hole of the body opening portion p12. The fixed member f12 is formed separately from the head body m12. The center of gravity of the fixed member f12 is located at a heel-side position with respect to the face center Fc.

The fixed member f12 has an outer surface 120 that forms a part of the outer surface 102*a* of the head 102. The outer surface 120 of the fixed member f12 forms a part of the sole outer surface 108*a*. The fixed member f12 has an inner surface 122 that forms a part of the inner surface 102*b* of the head 102. The inner surface 122 of the fixed member f12 forms a part of the sole inner surface 108*b*. The inner surface 122 of the fixed member f12 faces the hollow interior k1. In the present embodiment in which the fixed member f12 is disposed in the sole portion 108, the inner surface 122 of the fixed member f12 is the upper surface of the fixed member f12, and the outer surface 120 of the fixed member f12 is the lower surface of the fixed member f12.

Figure 18:
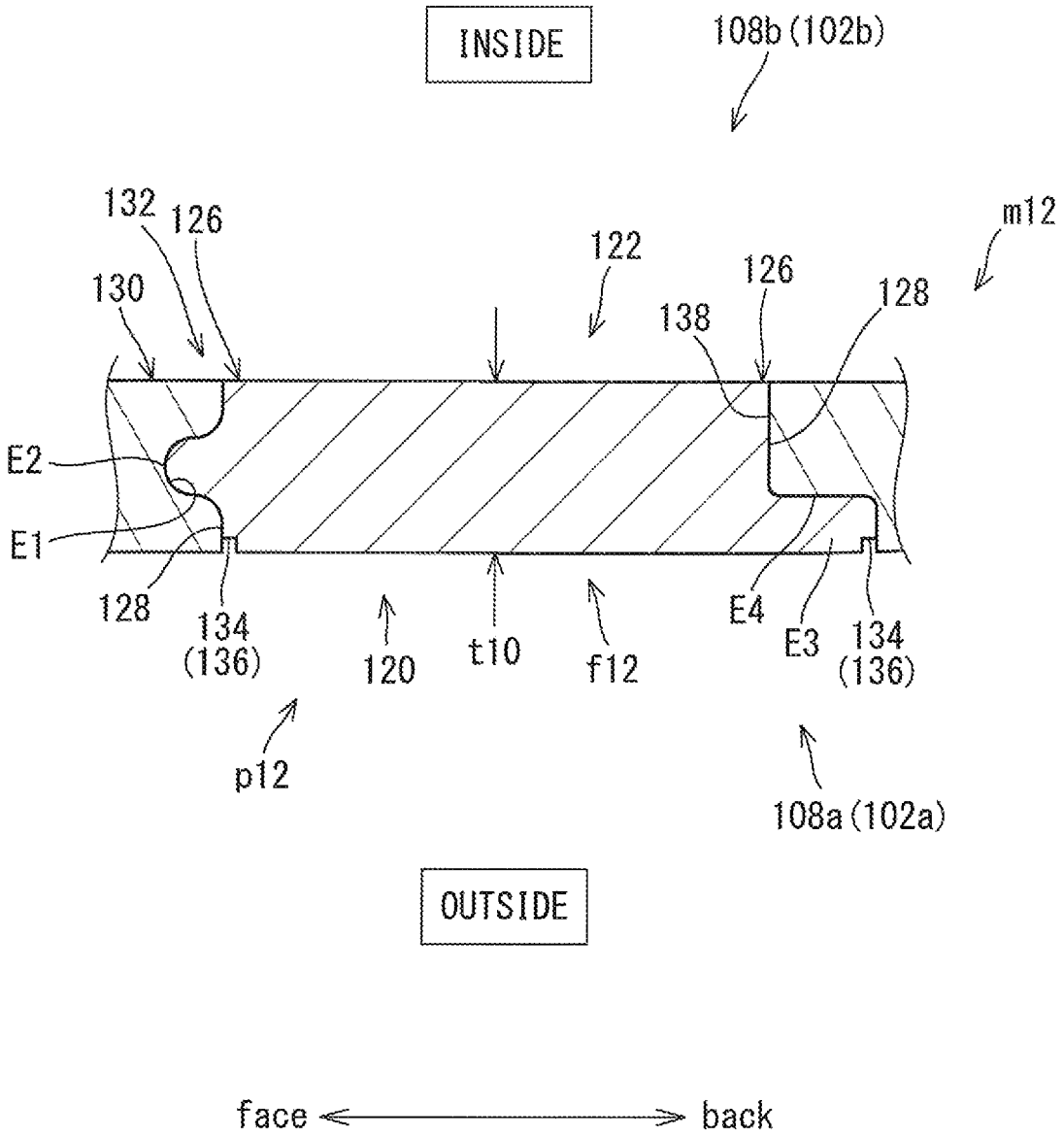
FIG. 18 is an enlarged cross-sectional view of a fixed member and its vicinity in FIG. 16.

FIG. 18 is a cross-sectional view in which a part of FIG. 16 is enlarged. FIG. 18 is an enlarged cross-sectional view of the fixed member f12 and its vicinity.

The fixed member f12 includes an outer peripheral portion 126. The outer peripheral portion 126 includes an engaging portion E2 that is constituted by at least one projection or recess. The engaging portion E2 of the outer peripheral portion 126 is also referred to as a second engaging portion, which makes a clear distinction from a first engaging portion described below. In the present embodiment, the second engaging portion E2 is a projection. As indicated with dashed lines in FIG. 15, three second engaging portions E2 are provided. The three respective second engaging portions E2 are also referred to as: a second engaging portion E211 that is provided on the face side of the fixed member f12; a second engaging portion E212 that is provided on the toe side of the fixed member f12; and a second engaging portion E213 that is provided on the heel side of the fixed member f12.

Each second engaging portion E2 is provided on a side surface 128 of the fixed member f12. Each second engaging portion E2 is located at an intermediate position in a thickness direction of the fixed member f12. Each second engaging portion E2 is located at an intermediate position in a thickness direction of the sole portion 108. The thickness direction of the sole portion 108 is the up-down direction. Each second engaging portion E2 is located apart from the sole outer surface 108*a*. Each second engaging portion E2 is located at an upper-side position with respect to the sole outer surface 108*a*. Each second engaging portion E2 is located apart from the outer surface 120 of the fixed member f12. Each second engaging portion E2 is located at a head inner-side position with respect to the outer surface 120. Each second engaging portion E2 is located apart from the sole inner surface 108*b*. Each second engaging portion E2 is located at a lower-side position with respect to the sole inner surface 108*b*. Each second engaging portion E2 is located apart from the inner surface 122 of the fixed member f12. Each second engaging portion E2 is located at a head outer-side position with respect to the inner surface 122.

The body opening portion p12 of the head body m12 includes an inner peripheral portion 130. The inner peripheral portion 130 includes an engaging portion E1 that is constituted by at least one projection or recess. The engaging portion E1 of the inner peripheral portion 130 is also referred to as a first engaging portion. In the present embodiment, the first engaging portion E1 is a recess. As indicated with dashed lines in FIG. 15, three first engaging portions E1 are provided. The three respective first engaging portions E1 are also referred to as: a first engaging portion E111 that is joined to the second engaging portion E211; a first engaging portion E112 that is joined to the second engaging portion E212; and a first engaging portion E113 that is joined to the second engaging portion E213.

The first engaging portions E1 and the second engaging portions E2 form projection-recess fittings. The projection-recess fittings are formed by the recesses and the projections being fitted into the recesses. The projection-recess fittings allow the outer peripheral portion 126 and the inner peripheral portion 130 to be joined to each other. As in the present embodiment, when the second engaging portions E2 are projections, the first engaging portions E1 are recesses. Alternatively, when the second engaging portions E2 are recesses, the first engaging portions E1 are projections. The projection-recess fitting(s) means a state where a projection (s) is/are fitted into a recess(es).

The projection-recess fittings between the first engaging portions E1 and the second engaging portions E2 are formed by insert casting (casting performed with the presence of an insert placed in a mold in advance). The fixed member f12 is fixed to the head body m12 by the insert casting. The fixed member f12 is integrated into the head body m12 by the insert casting. The projection-recess fittings between the first engaging portions E1 and the second engaging portions E2 are formed by the insert casting of the head body m12 performed with the presence of the fixed member f12 used as the insert. It should be noted that the method for forming the projection-recess fittings is not limited to the insert casting. Examples of the method other than the insert casting include press-fitting. In addition, as described below, the material of the fixed member need not necessarily be a metal, and thus the projection-recess fittings can be formed by various methods.

As described above, at least a part of the outer peripheral portion 126 is joined to the inner peripheral portion 130 of the body opening portion p12. In the present embodiment, a part of the outer peripheral portion 126 is joined to the inner peripheral portion 130 of the body opening portion p12. The part of the outer peripheral portion 126 and the inner peripheral portion 130 in the joined state form a joining portion 132.

The fixed member f12 includes a groove forming portion 134. The groove forming portion 134 is formed on the outer surface 120 of the fixed member f12. The groove forming portion 134 is formed at an edge portion of the outer surface 120. A groove 136 is formed by a combination of the groove forming portion 134 and the inner peripheral portion 130 adjacent to the groove forming portion 134. A filling material can be disposed in the groove 136. Such a filling material can improve the appearance of the boundary between the fixed member f12 and the head body m12. The filling material can be a coating material. The coating material can emphasize the presence of the fixed member f12 and/or improve the design aesthetics of the head. By providing the groove forming portion 134 in the fixed member f12, not in the head body m12, the strength deterioration of the head body m12 can be prevented.

The fixed member f12 includes an outer-surface forming projection E3. The outer-surface forming projection E3 is provided on the side surface 128. The outer-surface forming projection E3 is a projection provided on the side surface 128. The outer-surface forming projection E3 is provided at an end portion of the side surface 128 on the head outer side. The outer-surface forming projection E3 is provided at the lower end portion of the side surface 128. In the head 102, a part of the outer-surface forming projection E3 is exposed to the outside. The outer-surface forming projection E3 forms a part of the outer surface 102*a* of the head 102. The outer-surface forming projection E3 forms a part of the outer surface 120 of the fixed member f12. The outer surface of the body portion of the fixed member f12 is continuously flush with the outer surface of the outer-surface forming projection E3. Of the fixed member f12, a portion located inside the side surface 128 is the "body portion" of the fixed member f12.

The inner peripheral portion 130 of the head body m12 includes a stepped portion E4. The stepped portion E4 is a stepped-down portion (recess) provided on the side surface 138 of the inner peripheral portion 130. The stepped portion E4 is formed by a lack of material at an edge portion of the inner peripheral portion 130 on the head outer side. The stepped portion E4 is formed by a lack of material at the lower edge portion of the inner peripheral portion 130. The shape of the stepped portion E4 corresponds to the shape of the outer-surface forming projection E3. The stepped portion E4 is engaged with the outer-surface forming projection E3.

As shown in FIG. 15, the width Wb of the outer-surface forming projection E3 is greater than the width Wa of the second engaging portion E2. Alternatively, the width Wb may be smaller than the width Wa. Alternatively, the width Wa may be the same as the width Wb. The width Wa and the width Wb are measured in the planar view.

The engagement between the outer-surface forming projection E3 and the stepped portion E4 is formed by the insert casting. The engagement between the outer-surface forming projection E3 and the stepped portion E4 is attained by the insert casting of the head body m12 performed with the presence of the fixed member f12 used as the insert. It should be noted that the method for forming this engagement is not limited to the insert casting. The stepped portion E4 is opened downward (head outward). Therefore, this engagement is easily attained by fitting the outer-surface forming projection E3 into the stepped portion E4 from below (from head outer side).

In the present embodiment, the fixed member f12 is disposed in the sole portion 108. In this case, the term "head outer side or head outward" means the lower side or downward of the head. In contrast, when the fixed member f12 is disposed in the crown portion 106, the term "head outer side or head outward" means an upper side or upward of the head.

The material of the head body m12 is different from the material of the fixed member f12. The head body m12 is formed by a first material that has a first specific gravity. The fixed member f12 is formed by a second material having a second specific gravity. The first specific gravity is different from the second specific gravity. The first material is different from the second material.

In the present embodiment, the fixed member f12 is a weight member. In the present embodiment, the second specific gravity is higher than the first specific gravity. Providing the fixed member f12 having a higher specific gravity in the sole portion 108 can lower the position of the center of gravity of the head 102.

Figure 19:
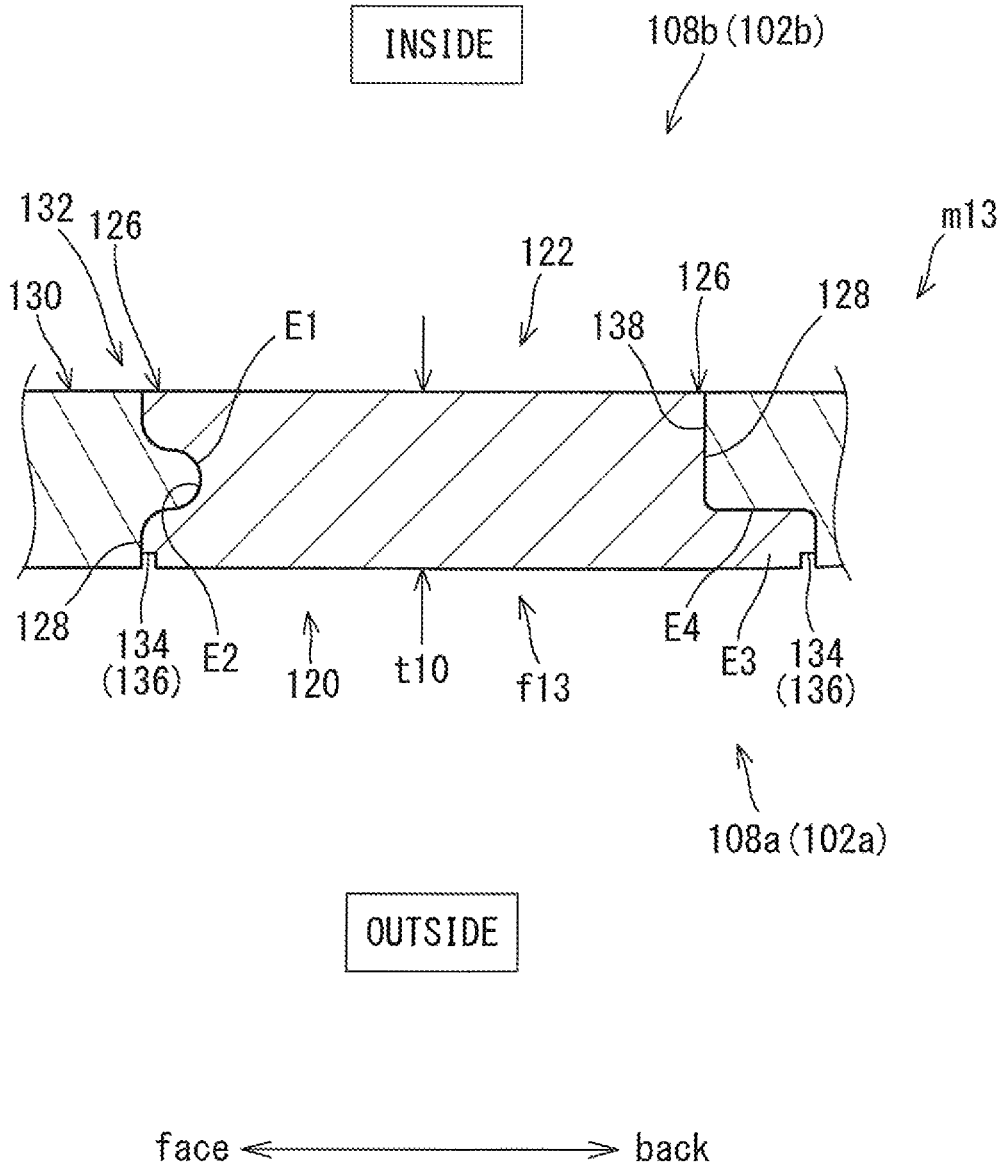
FIG. 19 is an enlarged cross-sectional view of a fixed member and its vicinity in a head according to a thirteenth embodiment.

FIG. 19 is a cross-sectional view showing a fixed member f13 and its vicinity in a head according to a thirteenth embodiment. This head includes a head body m13 and the fixed member f13. In the thirteenth embodiment, a second engaging portion E2 of an outer peripheral portion 126 is constituted by a recess, and a first engaging portion E1 of an inner peripheral portion 130 is constituted by a projection. Except for these portions, the head of the thirteenth embodiment is the same as the head 102 of the twelfth embodiment. As in this embodiment, in the projection-recess fitting between the first engaging portion E1 and the second engaging portion E2, the first engaging portion E1 of the head body m13 may be a projection and the second engaging portion E2 of the fixed member f13 may be a recess.

Figure 20:
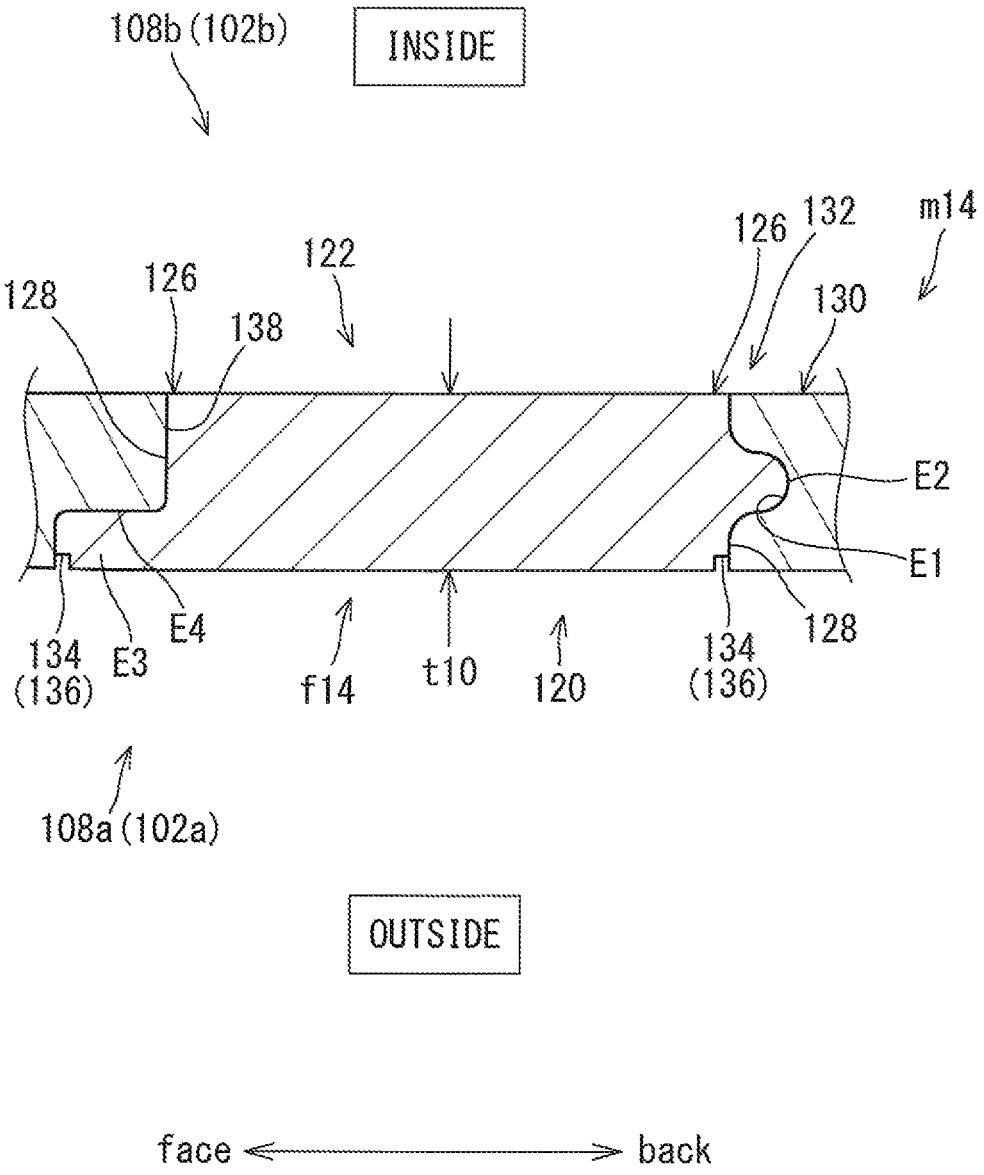
FIG. 20 is an enlarged cross-sectional view of a fixed member and its vicinity in a head according to a fourteenth embodiment.

FIG. 20 is a cross-sectional view showing a fixed member f14 and its vicinity in a head according to a fourteenth embodiment. This head includes a head body m14 and the fixed member f14.

As shown in FIG. 18, in the twelfth embodiment, the outer-surface forming projection E3 is provided on the back side of the fixed member f12, and the second engaging portion E2 is provided on the face side of the fixed member f12. In contrast, in the fourteenth embodiment shown in FIG. 20, the outer-surface forming projection E3 is provided on the face side of the fixed member f14, and the second engaging portion E2 is provided on the back side of the fixed member f14. As such, the positions of the second engaging portion E2 and the outer-surface forming projection E3 are not limited.

Figure 21:
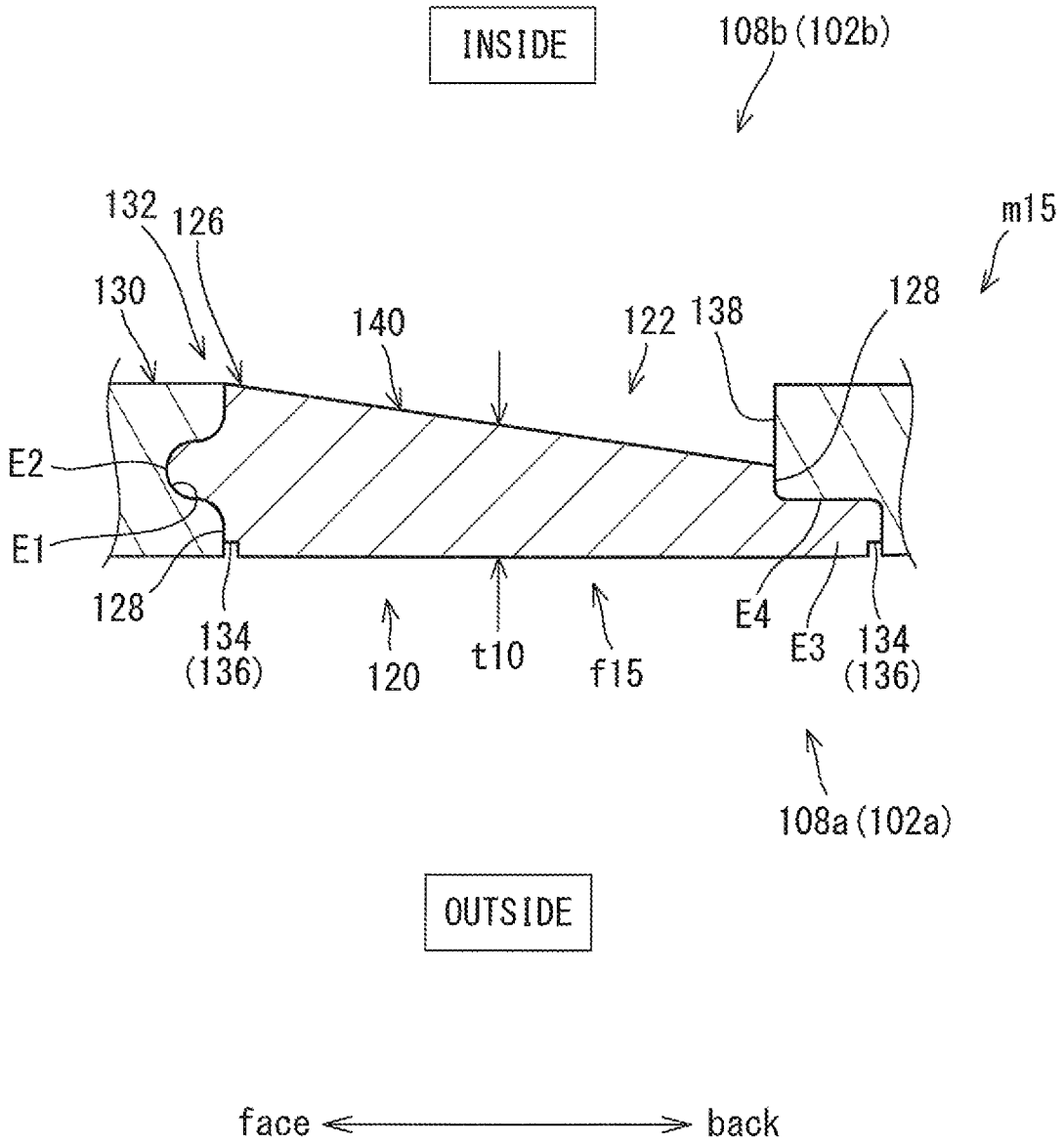
FIG. 21 is an enlarged cross-sectional view of a fixed member and its vicinity in a head according to a fifteenth embodiment.

FIG. 21 is a cross-sectional view showing a fixed member f15 and its vicinity in a head according to a fifteenth embodiment. This head includes a head body m15 and the fixed member f15.

The inner surface 122 of the fixed member f15 is inclined. The inner surface 122 is inclined such that an angle is formed between the inner surface 122 and the face-back direction. The inner surface 122 is inclined such that the inner surface 122 extends upward as it goes to the face side. The fixed member f15 includes a thickness changing portion 140 having a thickness t10 that increases toward the face side. The thickness t10 is measured in the up-down direction.

Figure 22:
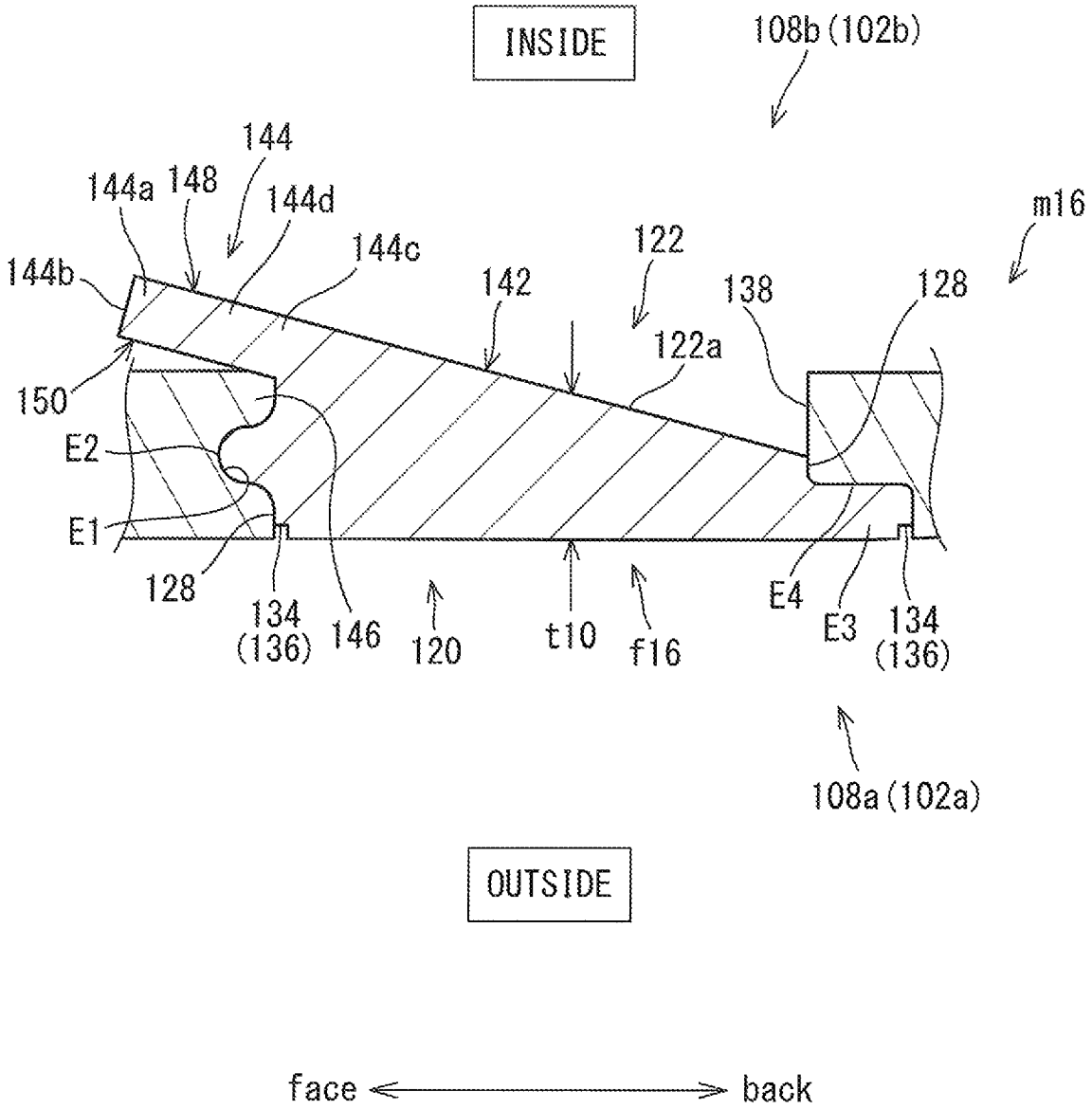
FIG. 22 is an enlarged cross-sectional view of a fixed member and its vicinity in a head according to a sixteenth embodiment.

FIG. 22 is a cross-sectional view showing a fixed member f16 and its vicinity in a head according to a sixteenth embodiment. This head includes a head body m16 and the fixed member f16.

The inner surface 122 of the fixed member f16 includes an inclined surface 122*a* that is inclined such that an angle is formed between the inclined surface 122*a* and the face-back direction. In the present embodiment, the entirety of the inner surface 122 is the inclined surface 122*a*. The inclined surface 122*a* is inclined such that the inclined surface 122*a* extends downward as it goes to the back side. The fixed member f16 includes a thickness changing portion 142 having a thickness t10 that increases toward the face side.

The fixed member f16 includes a protrusion 144 that protrudes to the inside of the head. The protrusion 144 protrudes to the hollow interior k1. The protrusion 144 protrudes from the inner surface 122 of the fixed member f16. The protrusion 144 protrudes such that the protrusion 144 extends upward as it goes to the face side. The protrusion 144 has a tip end 144*b* that is a free end. The tip end 144*b* of the protrusion 144 is located apart from the head body m16. The tip end 144*b* of the protrusion 144 is located apart from the sole portion 108. An end portion 144*a* of the protrusion 144 is located apart from the head body m16. The end portion 144*a* of the protrusion 144 is located apart from the sole portion 108. The end portion 144*a* of the protrusion 144 is a portion located on the face side in the protrusion 144.

The protrusion 144 includes a contacting portion 144*c* that is in contact with the head body m16 and a non-contacting portion 144*d* that is not in contact with the head body m16. The contacting portion 144*c* is a root portion of the protrusion 144. The non-contacting portion 144*d* is a portion located on the tip end 144*b* side relative to the contacting portion 144*c*. The non-contacting portion 144*d* is a portion located on the face side relative to the contacting portion 144*c*. The non-contacting portion 144*d* includes the end portion 144*a* and the tip end 144*b*.

A part of the head body m16 is sandwiched by the fixed member f16. The head member m16 includes a sandwiched portion 146 that is sandwiched by the fixed member f16. The sole portion 108 includes the sandwiched portion 146 that is sandwiched by the fixed member f16. The sandwiched portion 146 is sandwiched between the second engaging portion E2 and the protrusion 144 (contacting portion 144*c*).

The inner surface 148 of the protrusion 144 is a part of the inclined surface 122*a*. The inner surface 148 of the protrusion 144 is a part of the inner surface 122. The inner surface 148 of the protrusion 144 is continuously flush with the inner surface of the body portion of the fixed member f16. In the present embodiment, the inner surface 148 is the upper surface of the protrusion 144. The inner surface 148 is inclined such that an angle is formed between the inner surface 148 and the face-back direction. The inner surface 148 is inclined such that the inner surface 148 extends upward as it goes to the face side. In the present embodiment, the outer surface 150 of the protrusion 144 is the lower surface of the non-contacting portion 144*d*. The outer surface 150 is inclined such that an angle is formed between the outer surface 150 and the face-back direction. The outer surface 150 is inclined such that the outer surface 150 extends upward as it goes to the face side. The outer surface 150 is parallel to the inner surface 148. Alternatively, the outer surface 150 need not necessarily be parallel to the inner surface 148.

The above-described twelfth to sixteenth embodiments exhibit the following advantageous effects.

Since the fixed member and the body opening portion are mechanically joined to each other by the projection-recess fitting, the joining strength between the two can be increased. In some cases, weldability between the fixed member and the head body might be poor even when the fixed member is made of a metal and the head body is also made of a metal. Even in such cases, the projection-recess fitting enables the fixed member and the head body to be joined to each other.

In the above-described embodiments, the fixed member is disposed in the sole portion 108. When the fixed member is a weight member having a high specific gravity, the weight member can lower the position of the center of gravity of the head.

By providing the outer-surface forming projection E3, the fixed member can be disposed on the head outer side. Therefore, when the fixed member is a weight member and is disposed in the sole portion 108, the outer-surface forming projection E3 increases weight on the head lower side, which can further lower the position of the center of gravity of the head. The outer-surface forming projection E3 increases weight on the head outer side and thus the moment of inertia of the head can be increased.

The outer-surface forming projection E3 is engaged with the stepped portion E4 of the head body from the outside of the head. This engagement prevents the movement of the fixed member toward the inside of the head. Therefore, the fixed member is prevented from being removed from the head body. When the fixed member is provided in the sole portion 108, the fixed member tends to receive an external force that acts toward the inside of the head. For example, when the sole portion 108 is brought into contact with the ground, the fixed member receives an external force that acts toward the inside of the head. Against this external force, the outer-surface forming projection E3 engaging with the stepped portion E4 can effectively prevent the movement of the fixed member toward the inside of the head.

When the fixed member is a weight member and is disposed in the crown portion 106, the outer-surface forming projection E3 increases weight on the head upper side, which can raise the position of the center of gravity of the head. The outer-surface forming projection E3 increases weight on the head outer side and thus the moment of inertia of the head can be increased.

When the fixed member is a lightweight member having a low specific gravity, the outer-surface forming projection E3 can increase the amount of the saved weight to be redistributed to other location(s). This structure can improve the degree of freedom in the weight distribution of the head. When the fixed member is a lightweight member and is disposed in the sole portion 108, the outer-surface forming projection E3 reduces the weight of a lower portion of the head, which can further raise the position of the center of gravity of the head. When the fixed member is a lightweight member having a low specific gravity and is disposed in the crown portion 106, the outer-surface forming projection E3 reduces the weight of an upper portion of the head, which can further lower the position of the center of gravity of the head.

Thus, the specific gravity of the fixed member is different from the specific gravity of the head body and the outer-surface forming projection E3 is provided, which can improve the degree of freedom in the design of the head.

Normally, when the difference between the specific gravity of the material of the fixed member and the specific gravity of the material of the head body is large, the weldability between the two becomes poor. The projection-recess fitting, however, enables the fixed member and the head body to be joined to each other even when the difference in specific gravity between the two is large. For this reason, the fixed member may be a weight member having a larger weight, whereby the position of the center of gravity of the head can be effectively lowered, for example. Alternatively, the fixed member may be lightweight, and a weight saved by using the lightweight fixed member can be redistributed to other location(s) of the head, for example. An increase in the difference between the specific gravity of the fixed member and the specific gravity of the head body can enhance the degree of freedom in the design of the head.

In the above-described twelfth to sixteenth embodiments, a part of the sole portion 108 is substituted with the fixed member. That is, the outer surface 120 of the fixed member forms a part of the sole outer surface 108*a* (outer surface 102*a* of the head 102), and the inner surface 122 of the fixed member forms a part of the sole inner surface 108*b* (inner surface 102*b* of the head 102). The fixed member is not supported by the head body from the inside of the head. The fixed member penetrates through the sole portion 108. The fixed member occupies the whole sole portion 108 in the thickness direction. A part of the sole portion 108 (wall portion that forms the outer surface 102*a* and the inner surface 102*b* of the head 102) is formed by the fixed member only. This structure further enhances the advantageous effects brought by the difference in specific gravity between the head body and the fixed member. That is, when the fixed member is a weight member, the weight of a region where the fixed member is disposed can be increased. Accordingly, when the weight member is disposed in the sole portion 108, the advantageous effect of lowering the center of gravity of the head is enhanced. In contrast, when the fixed member is a lightweight member, the weight of a region where the fixed member is disposed can be decreased. Accordingly, the reduced weight can increase the amount of the saved weight to be redistributed to other location(s).

The thicknesses of the fixed member f15 in FIG. 21 and the fixed member f16 in FIG. 22 are thicker in their face side and thinner in their back side. For this reason, when the fixed member is disposed in the sole portion 108 and is used as a weight member, the center of gravity of the head can be effectively located at a shallow and lowered position. As a result, the position of a sweet spot can be effectively lowered. The term "shallow" used regarding the position of the center of gravity of the head means the position of the center of gravity of the head is located close to the face portion 104.

Hitting points are located closer to the sweet spot when the sweet spot is located at a lower position. Such a lower sweet spot is advantageous in clubs having many opportunities to hit a ball that is placed directly on the ground. The lower sweet spot is particularly advantageous in fairway wood type clubs and hybrid type clubs. It should be noted that the term "sweet spot" means an intersection point between the face surface 104*a* and a line normal to the face surface 104*a* and passing through the center of gravity of the head.

In the fixed member f16 shown in FIG. 22, the protrusion 144 extending toward the face side provides an additional weight to the face side of the head. This structure enables the center of gravity of the head to be located at a shallow position and enables the sweet spot to be located at a lower position. The protrusion 144 extending upward might lead to a higher center of gravity of the head. The outer-surface forming projection E3, however, can lower the center of gravity of the head. Therefore, the raised center of gravity of the head because of the protrusion 144 is offset by the lowered center of gravity of the head because of the outer-surface forming projection E3. As a result, the protrusion 144 can make a contribution in lowering the position of the sweet spot.

Of the protrusion 144, a portion located on the face side (non-contacting portion 144*d*) is not in contact with the sole portion 108 (head body m16). When a ball is hit with the golf club, the protrusion 144 does not hinder the deformation of a part of the sole portion 108 (head body m16) which is located closer to the face portion 104. This structure can improve the rebound performance of the head.

A part of the head 102 (sole portion 108) is sandwiched by the fixed member f16 in FIG. 22. This structure prevents the deformation of the wall (sole portion 108) of the head in the out-of-plane direction of the wall (sole portion 108). This structure also prevents the fixed member f16 from being removed from the head body m16.

Figure 23A:
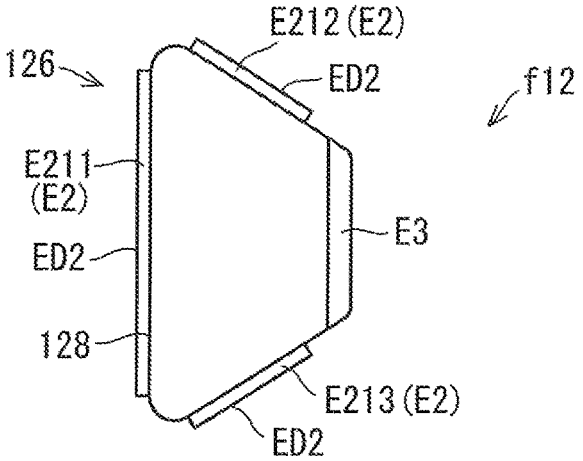
FIG. 23A is a plan view of the fixed member according to the twelfth embodiment.

FIG. 23A is a plan view of the fixed member f12 according to the twelfth embodiment. FIG. 23A is a plan view of the fixed member f12 as viewed from above (from the hollow interior k1 side). As described above, the fixed member f12 includes the plurality of second engaging portions E2. As the second engaging portions E2, the fixed member f12 includes the second engaging portion E211 formed on the face side of the fixed member f12, the second engaging portion E212 formed on the toe side of the fixed member f12, and the second engaging portion E213 formed on the heel side of the fixed member f12. The number of the outer-surface forming projection E3 is one. The outer-surface forming projection E3 is provided on the back side of the fixed member f12.

Figure 23B:
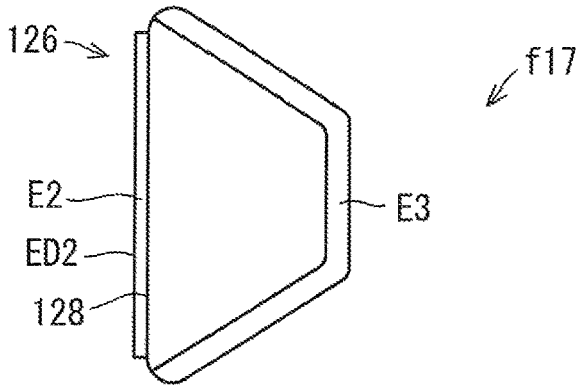
FIG. 23B is a plan view of a fixed member according to a seventeenth embodiment.

FIG. 23B is a plan view of a fixed member f17 according to a seventeenth embodiment. The fixed member f17 includes a single second engaging portion E2. The second engaging portion E2 is provided on the face side of the outer peripheral portion 126. The fixed member f17 includes a single outer-surface forming projection E3. The outer-surface forming projection E3 extends continuously from the toe side, through the back side, to the heel side of the outer peripheral portion 126. The outer-surface forming projection E3 curvedly extends.

Figure 23C:
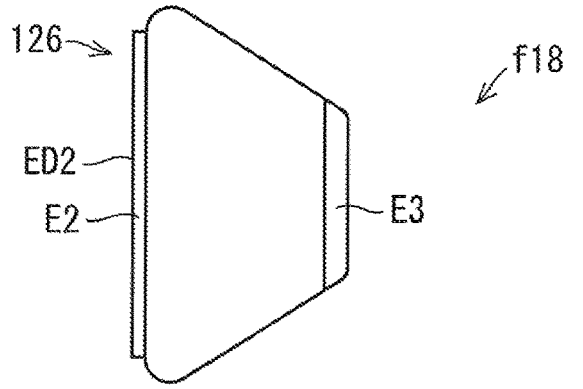
FIG. 23C is a plan view of a fixed member according to an eighteenth embodiment.

FIG. 23C is a plan view of a fixed member f18 according to an eighteenth embodiment. The fixed member f18 includes a single second engaging portion E2. The second engaging portion E2 is provided on the face side of the outer peripheral portion 126. The fixed member f18 includes a single outer-surface forming projection E3. The outer-surface forming projection E3 is provided on the back side of the outer peripheral portion 126.

Figure 23D:
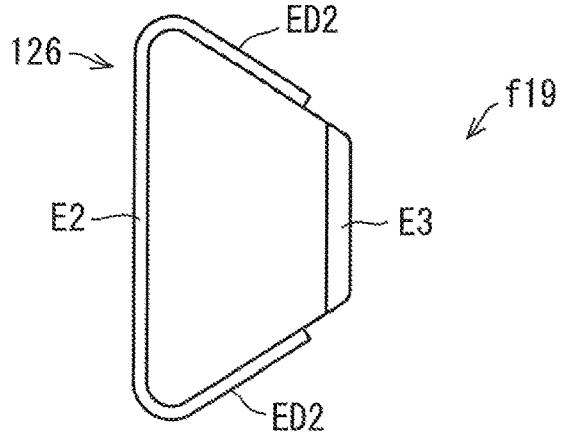
FIG. 23D is a plan view of a fixed member according to a nineteenth embodiment.

FIG. 23D is a plan view of a fixed member f19 according to a nineteenth embodiment. The fixed member f19 includes a single second engaging portion E2. The second engaging portion E2 extends continuously from the toe side, through the face side, to the heel side of the outer peripheral portion 126. The second engaging portion E2 extends curvedly. The fixed member f19 includes a single outer-surface forming projection E3. The outer-surface forming projection E3 is provided on the back side of the outer peripheral portion 126.

As shown in FIG. 23A to FIG. 23D, there is no limitation on the numbers and the positions of the second engaging portion(s) E2 and the outer-surface forming projection(s) E3.

In FIG. 23A to FIG. 23D, the second engaging portion(s) E2 is/are formed along the outer peripheral portion 126. Of these figures, in FIG. 23A and FIG. 23D, the second engaging portion(s) E2 is/are formed such that an outer edge(s) ED2 thereof pass(es) through at least three points that are not located in a single straight line in the planar view. This structure can prevent the deformation of the fixed member in the out-of-plane direction of the sole portion 108, which can prevent the fixed member from being removed from the sole portion 108. The out-of-plane direction of the sole portion 108 is substantially equal to the up-down direction. Regardless of the position of the fixed member, this advantageous effect is exhibited. For example, this advantageous effect is exhibited also when the fixed member is disposed in the crown portion 106. That is, this structure can prevent the deformation of the fixed member in the out-of-plane direction of the crown portion 106, which can prevent the fixed member from being removed from the crown portion 106.

In the fixed member f12 in FIG. 23A, the second engaging portions E2 are discontinuously formed. This structure allows the fixed member f12 to have the plurality of second engaging portions E2 that are independent from each other. In this case, the second engaging portions E2 are disposed at a plurality of positions, whereas an area in which the second engaging portion(s) is/are present (hereinafter referred to as "present area of the second engaging portion(s)") can be reduced. Reducing the present area of the second engaging portion(s) E2 can improve the degree of freedom in disposing the outer-surface forming projection(s).

According to a comparison between the fixed member f12 in FIG. 18 and the fixed member f14 in FIG. 20, the outer-surface forming projection E3 of the fixed member f12 is located on the back side, whereas the outer-surface forming projection E3 of the fixed member f14 is located on the face side. When the fixed member is disposed in the sole portion 108 and the outer-surface forming projection E3 is located in the back side, a larger amount of weight can be provided to the lower and back side in the head. This structure allows the center of gravity of the head to be located at a lower and deeper position. A deeper center of gravity of the head leads to a higher launch angle of a hit ball. When the fixed member is disposed in the sole portion 108 and the outer-surface forming projection E3 is located on the face side, a larger amount of weight can be provided to the lower and face side in the head. This structure allows the center of gravity of the head to be located at a lower and shallower position. Since the center of gravity of the head is located at a position closer to the face portion, the position of the sweet spot can be lowered.

As described above, in each of the head 2 and the head 102, the fixed member is fixed to the head body by the insert casting. The fixed member is formed separately from the head body. The method for forming the fixed member is not limited. Examples of the method for forming the fixed member include sintering, forging, casting, and press forming. The method for forming the head body is not limited. Examples of the method for forming the head body include forging, casting, and press forming. When the fixed member is fixed to the head body by the insert casting, the head body is formed by casting. In this case, the head body is preferably formed by lost-wax casting (lost-wax precision casting).

When the fixed member is fixed to the head body by the insert casting in the lost-wax casting, a wax model forming is performed by inserting the fixed member to a metal mold for wax models in advance, thereby forming a wax model of the head in which the fixed member is incorporated. After this process, usual processes of the lost-wax casting are performed to form a head in which the fixed member is fixed by the insert casting.

Joining performed by the insert casting has a high degree of freedom in the shape of the joining portion. Utilizing the insert casting improves the degree of freedom in the shapes of a recess and a projection in the projection-recess fitting. For this reason, even when the recess has a great depth and/or the projection has a great height, the insert casting enables the projection-recess fitting to be formed. The insert casting achieves a secure joining in the projection-recess fitting.

When the material of the fixed member is a resin, the head can also be obtained by inserting the head body into a metal mold in advance and forming the fixed member by injection of the resin into the mold. Also in this case, the degree of freedom in the shapes of a recess and a projection in the projection-recess fitting is high.

As described above, the head body is formed by the first material having the first specific gravity. The fixed member is formed by the second material having the second specific gravity.

There is no limitation on the first material. Examples of the first material include a metal, a non-metal, and a combination of these. Examples of the metal include a titanium alloy, stainless steel, maraging steel, an aluminum alloy, and a magnesium alloy. Examples of the non-metal include a fiber reinforced resin. From the viewpoint of strength, examples of a preferable fiber reinforced resin include a carbon fiber reinforced resin. In each of the head body m1 and the head body m12 of the above-described embodiments, the first material is a titanium alloy.

There is no limitation on the second material. Examples of the second material include a metal, a non-metal, and a combination of these. Examples of the metal include an alloy containing tungsten, a titanium alloy, stainless steel, maraging steel, an aluminum alloy, and a magnesium alloy. Examples of the alloy containing tungsten include an alloy obtained by adding nickel, iron and/or copper to tungsten powder and sintering them, such as a tungsten nickel alloy. Examples of the non-metal include a resin. Examples of a preferable resin include a fiber reinforced resin. From the viewpoint of strength, examples of a preferable fiber reinforced resin include a carbon fiber reinforced resin. In each of the fixed member f1 and the fixed member f12 of the above-described embodiments, the second material is an alloy containing tungsten. In each of the fixed member f1 and the fixed member f12, a tungsten nickel alloy is used as the alloy containing tungsten.

The specific gravity of the head body (first specific gravity) is denoted by S1, and the specific gravity of the fixed member (second specific gravity) is denoted by S2. When the fixed member is used as a weight member, the difference (S2−S1) is preferably greater than or equal to 5, more preferably greater than or equal to 6, and still more preferably greater than or equal to 7. Even when the difference between these specific gravities is great and thus the weldability between the head body and the fixed member is poor, the above-described structure enables the head body and the fixed member to be joined to each other. From the viewpoint of availabilities of the first material and the second material, the difference (S2−S1) is preferably less than or equal to 15, more preferably less than or equal to 14, and still more preferably less than or equal to 13. When the fixed member is used as a lightweight member, the difference (S1−S2) is preferably greater than or equal to 2, more preferably greater than or equal to 2.5, and still more preferably greater than or equal to 3. Even when the difference between these specific gravities is great and thus the weldability between the head body and the fixed member is poor, the above-described structure enables the head body and the fixed member to be joined to each other. From the viewpoint of availabilities of the first material and the second material, the difference (S1−S2) is preferably less than or equal to 8, more preferably less than or equal to 7, and still more preferably less than or equal to 6.

When the fixed member is used as a weight member, a higher second specific gravity S2 is needed. When such a higher second specific gravity S2 is adopted, an alloy containing tungsten, for example, is used as the second material. When the second specific gravity S2 is higher than the first specific gravity S1, the second specific gravity S2 is higher than or equal to 10, more preferably higher than or equal to 11, and still more preferably higher than or equal to 12. From the viewpoint of the availability of the material and the cost of forming, the second specific gravity S2 is preferably lower than or equal to 20, more preferably lower than or equal to 19, and still more preferably lower than or equal to 18.

When a lightweight fixed member f1 is preferred, a lower second specific gravity S2 is needed. In this case, examples of the second material include an aluminum alloy, a magnesium alloy and a fiber reinforced resin. When the second specific gravity S2 is lower than the first specific gravity S1, the second specific gravity S2 is preferably lower than or equal to 4.5, more preferably lower than or equal to 4, and still more preferably lower than or equal to 3. From the viewpoint of the strength of the fixed member f1, the second specific gravity S2 is preferably higher than or equal to 1, more preferably higher than or equal to 1.1, and still more preferably higher than or equal to 1.2.

From the viewpoint of adopting a material that has a suitable strength for the head body, the first specific gravity S1 is preferably higher than or equal to 2, more preferably higher than or equal to 3, and still more preferably higher than or equal to 4. An excessively high first specific gravity S1 reduces the degree of freedom in the design of the head. From this viewpoint, the first specific gravity S1 is preferably lower than or equal to 8, more preferably lower than or equal to 7, and still more preferably lower than or equal to 6.

As discussed above, when the weldability between the fixed member and the head body is poor, the above-described structure enables the fixed member to be fixed to the head body. From the viewpoint of the degree of freedom in the selection of the material of the fixed member, when the first material (head body) is a metal and the second material (fixed member) is also a metal, the weldability between the first material and the second material is preferably poor.

The poorness of the weldability can be determined based on the compositions of the metals. When at least one of the following items (A), (B), (C) and (D) is satisfied, the weldability tends to be poor.

(A) A component having the highest weight ratio in the first material is different from a component having the highest weight ratio in the second material.

(B) When at least one kind of component is contained in common in the first material and the second material, a content Rc1 (% by weight) of the common component in the first material is less than or equal to 30% by weight, further less than or equal to 20% by weight, still further less than or equal to 10% by weight, still further less than or equal to 5% by weight, still further less than or equal to 3% by weight, and yet still further less than or equal to 1% by weight. When two or more kinds of components are contained in common in the first material and the second material, the content Rc1 is the sum total of contents of the common components in the first material.

(C) When at least one kind of component is contained in common in the first material and the second material, a content Rc2 (% by weight) of the common component in the second material is less than or equal to 30% by weight, further less than or equal to 20% by weight, still further less than or equal to 10% by weight, still further less than or equal to 5% by weight, still further less than or equal to 3% by weight, and still further less than or equal to 1% by weight. When two or more kinds of components are contained in common in the first material and the second material, the content Rc2 is the sum total of contents of the common components in the second material.

(D) The first material and the second material have no common component.

A double-pointed arrow t2 in FIG. 5 shows the thickness of the joining portion 32 of the outer peripheral portion 26. Two-way arrows t3 in FIG. 5 shows the thickness of the inside region 28. The thickness t2 and the thickness t3 are measured in the up-down direction.

The thickness t2 of the joining portion 32 of the outer peripheral portion 26 is greater than the thickness t3 of the inside region 28. For this reason, when the fixed member is a weight member, the inside region 28 can be located at a further lower-side position (further head-outer-side position) while ensuring the required joining strength between the head body and the fixed member. Accordingly, when the fixed member is provided in the sole portion 8, the position of the center of gravity of the head can be lowered.

When the fixed member is a lightweight member, setting the thickness t2 to be greater than the thickness t3 can further reduce the weight of the inside region 28 while ensuring the required joining strength between the head body and the fixed member. By reducing the weight of a region where the fixed member is disposed, the amount of the reduced weight (saved weight) for relocating to other position(s) is increased and the degree of freedom in the design of the center of gravity of the head is improved.

From the viewpoint of increasing the joining strength in the projection-recess fitting, the thickness t2 is preferably greater than or equal to 3.0 mm, more preferably greater than or equal to 3.5 mm, and still more preferably greater than or equal to 4.0 mm. An excessively great thickness t2 increases the weight of the inner peripheral portion 30, which can reduce the degree of freedom in the design of the center of gravity of the head. From this viewpoint, the thickness t2 is less than or equal to 6.0 mm, more preferably less than or equal to 5.5 mm, and still more preferably less than or equal to 5.0.

From the viewpoint of enhancing the advantageous effects brought by the inner-surface recess 24, a ratio (t3/t2) is preferably less than or equal to 0.9, more preferably less than or equal to 0.8, and still more preferably less than or equal to 0.7. From the viewpoint of increasing the strength of the fixed member itself, the ratio (t3/t2) is preferably greater than or equal to 0.4, more preferably greater than or equal to 0.5, and still more preferably greater than or equal to 0.6.

From the viewpoint of the strength of the fixed member, the thickness t1 of the fixed member is preferably greater than or equal to 2.0 mm, more preferably greater than or equal to 2.5 mm, and still more preferably greater than or equal to 3.0 mm. An excessively great thickness t1 causes the enlargement of the fixed member toward the inside of the head, which can result in the deterioration of the advantageous effects brought by the inner-surface recess 24. From this viewpoint, the thickness t1 is preferably less than or equal to 6.0 mm, more preferably less than or equal to 5.5 mm, and still more preferably less than or equal to 5.0 mm.

From the viewpoint of the strength of the fixed member, the thickness t10 of the fixed member is preferably greater than or equal to 2.0 mm, more preferably greater than or equal to 2.5 mm, and still more preferably greater than or equal to 3.0 mm. An excessively great thickness t10 causes the enlargement of the fixed member toward the inside of the head, which can result in the deterioration of the advantageous effects brought by the outer-surface forming projection E3 provided on the outer side of the head. From this viewpoint, the thickness t10 is preferably less than or equal to 6.0 mm, more preferably less than or equal to 5.5 mm, and still more preferably less than or equal to 5.0 mm.

In the embodiment of FIG. 3, the head body m1 of the head 2 includes the inner peripheral portion 30 of the body opening portion p1, a back-side thin-wall portion 62 that is located on the back side with respect to the body opening portion p1, and a face-side thin-wall portion 64 that is located on the face side with respect to the body opening portion p1. The back-side thin-wall portion 62 has a thickness t4 that is smaller than the thickness t2. The thickness t4 of the back-side thin-wall portion 62 is smaller than the thickness t3. The thickness t4 is the minimum thickness in the sole portion 8. The face-side thin-wall portion 64 has a thickness t5 that is smaller than the thickness t2. The thickness t5 of the face-side thin-wall portion 64 is smaller than the thickness t3. The thickness t5 is the minimum thickness in the sole portion 8. The thickness t4 and the thickness t5 are measured in the up-down direction.

A double-pointed arrow t6 in FIG. 5 shows the thickness of the joining portion 32 of the inner peripheral portion 30. In the present embodiment, the thickness t6 is equal to the thickness t2. The thickness t6 is greater than the thickness t4 of the back-side thin-wall portion 62. The thickness t6 is greater than the thickness t5 of the face-side thin-wall portion 64. Such a greater thickness t6 improves molten metal flow at the joining portion 32 in the process of the insert casting. Therefore, the projection-recess fitting can be formed with a low defective rate. The thickness t6 is measured in the up-down direction.

There is no limitation on the position of the fixed member. The fixed member may be disposed in the sole portion, may be disposed in the crown portion, or may be disposed in the hitting face portion. The fixed member may be disposed in a region extending from the crown portion into the sole portion. When a head having a side portion (skirt portion)

located between the crown portion and the sole portion is adopted, the fixed member may be disposed in the side portion (skirt portion).

FIG. 2 and FIG. 15 show planar views of the respective sole portions. When the fixed member is provided in the sole portion, there is no limitation on a ratio of the area of the fixed member to the area of the sole outer surface. From the viewpoint of enhancing the advantageous effects brought by the fixed member, the ratio of the area of the fixed member to the area of the sole outer surface is preferably greater than or equal to 5%, more preferably greater than or equal to 7%, and still more preferably greater than or equal to 9%. From the viewpoint of the strength of the head, an excessively large body opening portion is not preferable. From this viewpoint, the ratio of the area of the fixed member to the area of the sole outer surface is preferably less than or equal to 60%, more preferably less than or equal to 50%, and still more preferably less than or equal to 40%. This ratio of these areas is determined in the planar view.

There is no limitation on the volume of the head. When a head having the fixed member f1 is adopted, an excessively large head volume, however, places restrictions on the thickness of the inner peripheral portion. From the viewpoint of the degree of freedom in the design of the inner peripheral portion, the head volume is preferably less than or equal to 300 cc, more preferably less than or equal to 250 cc, and still more preferably less than or equal to 200 cc. When a head having the fixed member f12 is adopted, it is highly advantageous for fairway wood type heads and hybrid type heads to lower the position of the sweet spot. From this viewpoint, the head volume is preferably less than or equal to 300 cc, more preferably less than or equal to 250 cc, and still more preferably less than or equal to 200 cc. From the viewpoint of the degree of freedom in the position of the fixed member, the head volume is preferably greater than or equal to 70 cc, more preferably greater than or equal to 80 cc, and still more preferably greater than or equal to 90 cc.

There is no limitation on the type of the hollow head. Examples of the hollow head include a wood type head, a hybrid type head, an iron type head, and a putter type head.

Examples of the wood type head include a driver head and a fairway wood type head.

The driver means a number 1 wood (W #1). The driver head usually includes a face outer surface that is a curved surface. This curved face outer surface includes a face bulge and a face roll. The volume of the driver head is typically greater than or equal to 300 cc and less than or equal to 460 cc. The real loft angle of the driver head is typically greater than or equal to 7 degrees and less than or equal to 14 degrees.

Examples of fairway wood type clubs include a number 3 wood (W #3), a number 4 wood (W #4), a number 5 wood (W #5), a number 7 wood (W #7), a number 9 wood (W #9), a number 11 wood (W #11), and a number 13 wood (W #13). A head for the fairway wood type clubs (fairway wood type head) includes a face outer surface that is a curved surface. The face outer surface includes a face bulge and a face roll. The volume of the fairway wood type head is typically greater than or equal to 100 cc and less than 300 cc, and more preferably greater than or equal to 100 cc and less than or equal to 200 cc. The real loft angle of the fairway wood type head is typically greater than 14 degrees and less than or equal to 33 degrees.

The hybrid type head usually includes a face outer surface that is a curved surface. The face outer surface includes a face bulge and a face roll. The volume of the hybrid type head is typically greater than or equal to 100 cc and less than or equal to 200 cc, and more preferably greater than or equal to 100 cc and less than or equal to 150 cc.

The iron type head usually includes a face outer surface that is a flat surface. An iron type hollow head is also referred to as an iron type hybrid head.

From the viewpoint of the degree of freedom in the design of the inner peripheral portion 30, a fairway wood type head and a hybrid type head are preferable. Also from the viewpoint of the advantageousness of a lower sweet spot, a fairway wood type head and a hybrid type head are preferable. From the viewpoint of the degree of freedom in the position of the fixed member, a driver head and a fairway wood type head are preferable.

Regarding the above-described embodiments, the following clauses are disclosed.

[Clause 1]

A golf club head including: a hollow interior; a sole portion; and a hitting face portion, wherein the golf club head includes a head body and a fixed member that is fixed to the head body, the head body is formed by a first material that has a first specific gravity, the fixed member is formed by a second material that has a second specific gravity, the head body includes a body opening portion forming a body opening that penetrates through a wall of the golf club head from an outside of the golf club head to the hollow interior, the fixed member forms a part of an inner surface and a part of an outer surface of the golf club head and is disposed inside the body opening portion, the fixed member includes an outer peripheral portion and an inside region that is located inside the outer peripheral portion, at least a part of the outer peripheral portion is joined to an inner peripheral portion of the body opening portion such that the part of the outer peripheral portion and the inner peripheral portion form a joining portion, the inner peripheral portion of the body opening portion includes a first engaging portion that is constituted by at least one projection or recess, the outer peripheral portion of the fixed member includes a second engaging portion that is constituted by at least one projection or recess, the first engaging portion and the second engaging portion form a projection-recess fitting such that the inner peripheral portion and the outer peripheral portion are joined to each other, and an inner surface of the inside region is located on a head outer side with respect to an innermost end of the joining portion.

[Clause 2]

The golf club head according to clause 1, wherein the fixed member includes an inner-surface recess on an inner surface of the fixed member, the inside region is a portion located inside the inner-surface recess, and the outer peripheral portion is a portion located outside the inner-surface recess.

[Clause 3]

The golf club head according to clause 1 or 2, wherein the body opening portion is provided in the sole portion of the golf club head, an inner surface of the fixed member forms at least a part of an inner surface of the sole portion, an outer surface of the fixed member forms at least a part of an outer surface of the sole portion, and the inner surface of the inside region is located on a lower side with respect to an upper end of the joining portion.

[Clause 4]

The golf club head according to any one of clauses 1 to 3, wherein the fixed member is fixed to the head body by insert casting.

[Clause 5]

The golf club head according to any one of clauses 1 to 4, wherein the second specific gravity is higher than the first specific gravity.

[Clause 6]

The golf club head according to any one of clauses 1 to 5, wherein the first material is a titanium alloy, and the second material is an alloy containing tungsten.

[Clause 7]

A golf club head including: a hollow interior; a sole portion; and a hitting face portion, wherein the golf club head includes a head body and a fixed member that is fixed to the head body, the head body is formed by a first material that has a first specific gravity, the fixed member is formed by a second material that has a second specific gravity, the head body includes a body opening portion forming a body opening that penetrates through a wall of the golf club head from an outside of the golf club head to the hollow interior, the fixed member forms a part of an inner surface and a part of an outer surface of the golf club head and is disposed inside the body opening portion, at least a part of an outer peripheral portion of the fixed member is joined to an inner peripheral portion of the body opening portion such that the part of the outer peripheral portion and the inner peripheral portion form a joining portion, the inner peripheral portion of the body opening portion includes a first engaging portion that is constituted by at least one projection or recess, and a stepped portion that is formed on an outer-surface side of the golf club head, the outer peripheral portion of the fixed member includes a second engaging portion that is constituted by at least one projection or recess, and an outer-surface forming projection that is constituted by at least one projection and forms a part of the outer surface of the golf club head, the first engaging portion and the second engaging portion form a projection-recess fitting such that the inner peripheral portion and the outer peripheral portion are joined to each other, and the outer-surface forming projection is engaged with the stepped portion.

[Clause 8]

The golf club head according to clause 7, wherein the body opening portion is provided in the sole portion, an inner surface of the fixed member forms at least a part of an inner surface of the sole portion, an outer surface of the fixed member forms at least a part of an outer surface of the sole portion, and the outer-surface forming projection forms a part of the outer surface of the sole portion.

[Clause 9]

The golf club head according to clause 7 or 8, wherein the second engaging portion is formed along the outer peripheral portion, and the second engaging portion is formed discontinuously.

[Clause 10]

The golf club head according to any one of clauses 7 to 9, wherein in a planar view, the second engaging portion is formed such that an outer edge of the second engaging portion passes through at least three points that are not located in a single straight line.

[Clause 11]

The golf club head according to any one of clauses 7 to 10, wherein the fixed member is fixed to the head body by insert casting.

[Clause 12]

The golf club head according to any one of clauses 7 to 11, wherein the second specific gravity is higher than the first specific gravity.

[Clause 13]

The golf club head according to any one of clauses 7 to 12, wherein the first material is a titanium alloy, and the second material is an alloy containing tungsten.

LIST OF REFERENCE NUMERALS

2 Golf club head
4 Hitting face portion
4*a* Face outer surface
4*b* Face inner surface
6 Crown portion
6*a* Crown outer surface
6*b* Crown inner surface
8 Sole portion
8*a* Sole outer surface
8*b* Sole inner surface
10 Hosel portion
12 Hosel hole
20 Outer surface of fixed member
22 Inner surface of fixed member
24 Inner-surface recess
26 Outer peripheral portion
28 Inside region
30 Inner peripheral portion of body opening portion
32 Joining portion
32*a* Innermost end of joining portion
m1 to m8 Head body
p1 to p8 Body opening portion
f1 to f11 Fixed member
k1 Hollow interior
E1 First engaging portion
E2 Second engaging portion
102 Golf club head
104 Hitting face portion
104*a* Face outer surface
104*b* Face inner surface
106 Crown portion
106*a* Crown outer surface
106*b* Crown inner surface
108 Sole portion
108*a* Sole outer surface
108*b* Sole inner surface
110 Hosel portion
112 Hosel hole
120 Outer surface of fixed member
122 Inner surface of fixed member
126 Outer peripheral portion
128 Side surface of fixed member

130 Inner peripheral portion of body opening portion
132 Joining portion
m12 to m16 Head body
f12 to f19 Fixed member
E3 Outer-surface forming projection
E4 Stepped portion The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising", "having", "including", and "containing" are to be construed as open-ended terms (i.e., meaning "including, but not limited to") unless otherwise noted.

What is claimed is:

1. A golf club head comprising: a hollow interior; a sole portion; and a hitting face portion, wherein the golf club head includes a head body and a fixed member that is fixed to the head body, the head body is formed by a first material that has a first specific gravity, the fixed member is formed by a second material that has a second specific gravity, the head body includes a body opening portion forming a body opening that penetrates through a wall of the golf club head from an outside of the golf club head to the hollow interior, the fixed member forms a part of an inner surface and a part of an outer surface of the golf club head and is disposed inside the body opening portion, the fixed member includes an outer peripheral portion and an inside region that is located inside the outer peripheral portion, at least a part of the outer peripheral portion is joined to an inner peripheral portion of the body opening portion such that the part of the outer peripheral portion and the inner peripheral portion form a joining portion, the inner peripheral portion of the body opening portion includes a first engaging portion that is constituted by at least one projection or recess, the outer peripheral portion of the fixed member includes a second engaging portion that is constituted by at least one projection or recess, the first engaging portion and the second engaging portion form a projection-recess fitting such that the inner peripheral portion and the outer peripheral portion are joined to each other, an inner surface of the inside region is located on a head outer side with respect to an innermost end of the joining portion, the body opening portion is provided in the sole portion of the golf club head, an inner surface of the fixed member forms at least a part of an inner surface of the sole portion, an outer surface of the fixed member forms at least a part of an outer surface of the sole portion, and the inner surface of the inside region is located on a lower side with respect to an upper end of the joining portion.

2. The golf club head according to claim 1, wherein the fixed member includes an inner-surface recess on an inner surface of the fixed member, the inside region is a portion located inside the inner-surface recess, and the outer peripheral portion is a portion located outside the inner-surface recess.

3. The golf club head according to claim 1, wherein the fixed member is fixed to the head body by insert casting.

4. The golf club head according to claim 1, wherein the second specific gravity is higher than the first specific gravity.

5. A golf club head comprising: a hollow interior; a sole portion; and a hitting face portion, wherein the golf club head includes a head body and a fixed member that is fixed to the head body, the head body is formed by a first material that has a first specific gravity, the fixed member is formed by a second material that has a second specific gravity, the head body includes a body opening portion forming a body opening that penetrates through a wall of the golf club head from an outside of the golf club head to the hollow interior, the fixed member forms a part of an inner surface and a part of an outer surface of the golf club head and is disposed inside the body opening portion, the fixed member includes an outer peripheral portion and an inside region that is located inside the outer peripheral portion, at least a part of the outer peripheral portion is joined to an inner peripheral portion of the body opening portion such that the part of the outer peripheral portion and the inner peripheral portion form a joining portion, the inner peripheral portion of the body opening portion includes a first engaging portion that is constituted by at least one projection or recess, the outer peripheral portion of the fixed member includes a second engaging portion that is constituted by at least one projection or recess, the first engaging portion and the second engaging portion form a projection-recess fitting such that the inner peripheral portion and the outer peripheral portion are joined to each other, an inner surface of the inside region is located on a head outer side with respect to an innermost end of the joining portion, the first material is a titanium alloy, and the second material is an alloy containing tungsten.

6. A golf club head comprising: a hollow interior; a sole portion; and a hitting face portion, wherein the golf club head includes a head body and a fixed member that is fixed to the head body, the head body is formed by a first material that has a first specific gravity, the fixed member is formed by a second material that has a second specific gravity, the head body includes a body opening portion forming a body opening that penetrates through a wall of the golf club head from an outside of the golf club head to the hollow interior, the fixed member forms a part of an inner surface and a part of an outer surface of the golf club head and is disposed inside the body opening portion, at least a part of an outer peripheral portion of the fixed member is joined to an inner peripheral portion of the body opening portion such that the part of the outer peripheral portion and the inner peripheral portion form a joining portion, the inner peripheral portion of the body opening portion includes a first engaging portion that is constituted by at least one projection or recess, and a stepped portion that is formed on an outer-surface side of the golf club head, the outer peripheral portion of the fixed member includes a second engaging portion that is constituted by at least one projection or recess, and an outer-surface forming projection that is constituted by at least one projection and forms a part of the outer surface of the golf club head, the first engaging portion and the second engaging portion form a projection-recess fitting such that the inner peripheral portion and the outer peripheral portion are joined to each other, and the outer-surface forming projection is engaged with the stepped portion.

7. The golf club head according to claim 6, wherein the body opening portion is provided in the sole portion, an inner surface of the fixed member forms at least a part of an inner surface of the sole portion, an outer surface of the fixed member forms at least a part of an outer surface of the sole portion, and the outer-surface forming projection forms a part of the outer surface of the sole portion.

8. The golf club head according to claim 6, wherein the second engaging portion is formed along the outer peripheral portion, and the second engaging portion is formed discontinuously.

9. The golf club head according to claim 6, wherein in a planar view, the second engaging portion is formed such that an outer edge of the second engaging portion passes through at least three points that are not located in a single straight line.

10. The golf club head according to claim 6, wherein the fixed member is fixed to the head body by insert casting.

11. The golf club head according to claim 6, wherein the second specific gravity is higher than the first specific gravity.

12. The golf club head according to claim 6, wherein the first material is a titanium alloy, and the second material is an alloy containing tungsten.

* * * * *